US006795020B2

(12) United States Patent
Sreenivas et al.

(10) Patent No.: US 6,795,020 B2
(45) Date of Patent: Sep. 21, 2004

(54) DUAL BAND COPLANAR MICROSTRIP INTERLACED ARRAY

(75) Inventors: Ajay I. Sreenivas, Niwot, CO (US); Farzin Lalezari, Boulder, CO (US)

(73) Assignee: Ball Aerospace and Technologies Corp., Boulder, CO (US)

( * ) Notice: Subject to any disclaimer, the term of this patent is extended or adjusted under 35 U.S.C. 154(b) by 142 days.

(21) Appl. No.: 10/056,413

(22) Filed: Jan. 24, 2002

(65) Prior Publication Data

US 2003/0137456 A1 Jul. 24, 2003

(51) Int. Cl.[7] ..... H01Q 1/38

(52) U.S. Cl. ..... 343/700 MS; 343/824; 343/893

(58) Field of Search ..... 343/700 MS, 793, 343/795, 824, 829, 846, 853, 893, 727

(56) References Cited

U.S. PATENT DOCUMENTS

| | | | | | |
|---|---|---|---|---|---|
| 4,263,598 | A | | 4/1981 | Bellee et al. | 343/700 |
| 4,623,894 | A | | 11/1986 | Lee et al. | 343/700 |
| 4,870,426 | A | | 9/1989 | Lamberty et al. | 343/727 |
| 4,929,959 | A | | 5/1990 | Sorbello et al. | 343/700 |
| 5,208,603 | A | | 5/1993 | Yee | 343/909 |
| 5,231,406 | A | | 7/1993 | Sreenivas | 343/700 |
| 5,382,959 | A | | 1/1995 | Pett et al. | 343/700 |
| 5,444,452 | A | | 8/1995 | Itoh et al. | 343/700 |
| 5,453,751 | A | | 9/1995 | Tsukamoto et al. | 343/700 |
| 5,471,221 | A | | 11/1995 | Nalbandian et al. | 343/700 |
| 5,510,803 | A | | 4/1996 | Ishizaka et al. | 343/700 |
| 5,534,877 | A | | 7/1996 | Sorbello et al. | 343/700 |
| 5,561,434 | A | | 10/1996 | Yamazaki | 343/700 |
| 5,838,282 | A | | 11/1998 | Lalezari et al. | 343/727 |
| 5,859,616 | A | * | 1/1999 | Gans et al. | 343/700 MS |
| 5,872,545 | A | | 2/1999 | Rammos | 343/770 |
| 5,923,296 | A | | 7/1999 | Sanzgiri et al. | 343/700 |
| 5,955,994 | A | * | 9/1999 | Staker et al. | 343/700 MS |
| 6,054,953 | A | | 4/2000 | Lindmark | 343/700 |
| 6,075,485 | A | | 6/2000 | Lilly et al. | 343/700 |
| 6,114,998 | A | * | 9/2000 | Schefte et al. | 343/700 MS |
| 6,118,406 | A | | 9/2000 | Josypenko | 343/700 |
| 6,121,931 | A | | 9/2000 | Levi | 343/700 |
| 6,175,333 | B1 | | 1/2001 | Smith et al. | 343/700 |
| 6,181,277 | B1 | | 1/2001 | Kesler et al. | 343/700 |
| 6,191,740 | B1 | | 2/2001 | Kates et al. | 343/700 |
| 6,208,299 | B1 | | 3/2001 | Lindmark et al. | 343/700 |
| 6,483,481 | B1 | * | 11/2002 | Sievenpiper et al. | 343/909 |
| 6,529,166 | B2 | * | 3/2003 | Kanamaluru | 343/700 MS |

FOREIGN PATENT DOCUMENTS

| | | | |
|---|---|---|---|
| DE | 4021 167 A1 | 1/1991 | G01S/13/02 |
| EP | 0 433 255 | 1/1997 | H01Q/5/00 |

* cited by examiner

*Primary Examiner*—Shih-Chao Chen
(74) *Attorney, Agent, or Firm*—Sheridan Ross P.C.

(57) ABSTRACT

A dual band coplanar microstrip interlaced array antenna is provided. The antenna may be confined to a relatively small area, while providing dual band operation with no or minimal grating lobes and losses. According to the present invention, first and second arrays are interlaced with one another to minimize the surface area of the antenna. A maximum spacing between array elements is selected based on the operating wavelengths and scan range for each of the arrays. A first dielectric constant of a material underlying elements of the first array is calculated from the selected element spacing and the operating wavelength of the first array. A second dielectric constant of a material underlying elements of the second array is calculated from the first dielectric constant and the operating frequencies of the first and second arrays. The present invention provides a dual band coplanar microstrip interlaced array antenna capable of efficient operation at two center frequencies. A material having a modified effective dielectric constant and a method for modifying the effective dielectric constant of a material are also provided.

40 Claims, 18 Drawing Sheets

Fig. 1A
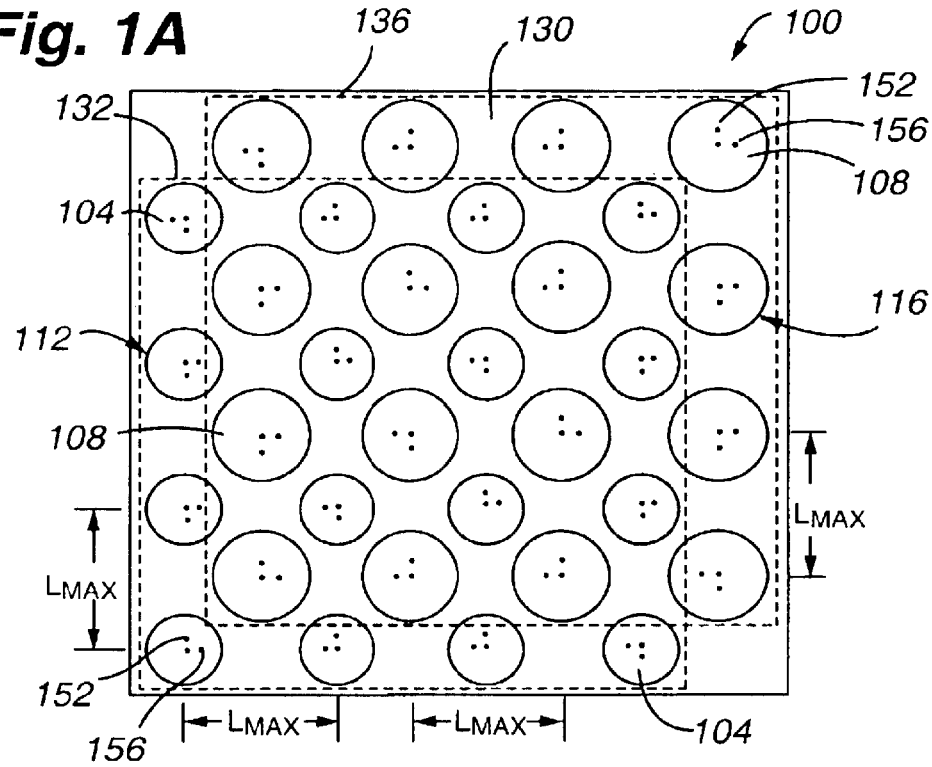
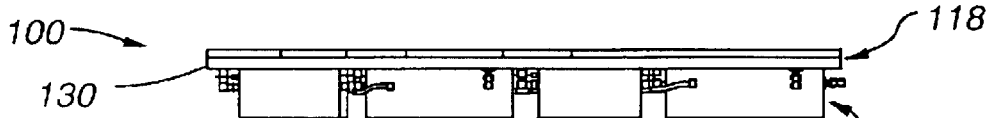
Fig. 1B
Fig. 1C
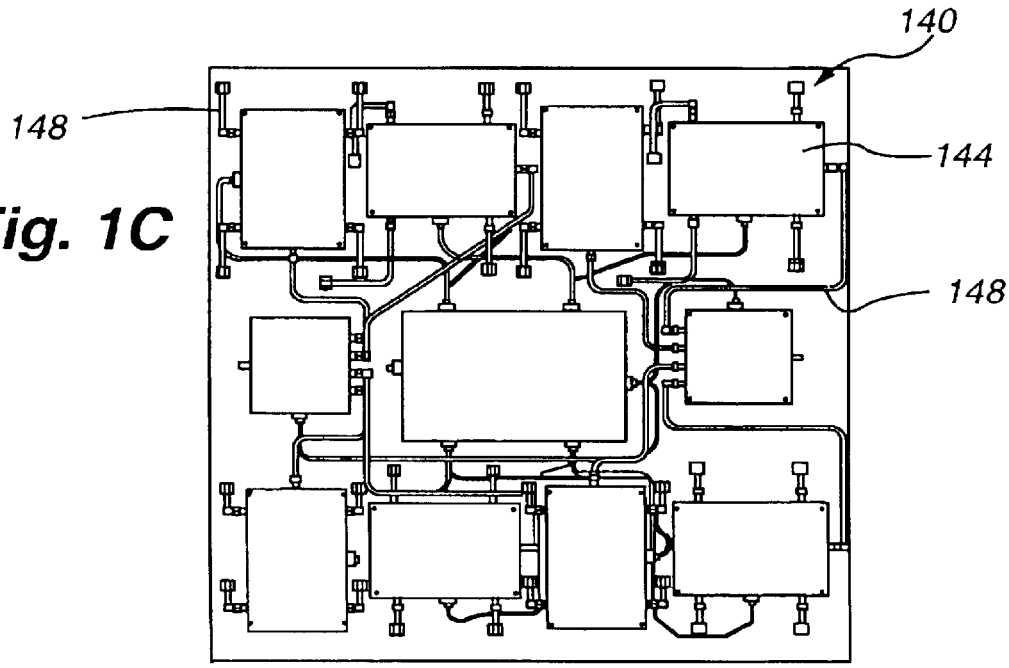

CP1383 is 1575MHz,
CP1383 is 1575MHz,

Function Values:
PHI ANGLE:45.0,
PHI ANGLE:45.0,

Max: 18.73dB at -1deg, Min:-56.13dB at 151deg
Max: -9.81dB at -5deg, Min:-62.69dB at -178deg

DUAL BAND COPLANAR MICROSTRIP INTERLACED ARRAY

FIELD OF THE INVENTION

The present invention relates to dual band, coplanar antennas. In particular, the present invention relates to dual band coplanar antennas having interlaced arrays to minimize the surface area required by the antenna.

BACKGROUND OF THE INVENTION

Antennas are used to radiate and receive radio frequency signals. The transmission and reception of radio frequency signals is useful in a broad range of activities. For instance, radio wave communication systems are desirable where communications are transmitted over large distances. In addition, radio frequency signals can be used in connection with obtaining geographic position information.

In order to provide desired gain and directional characteristics, the dimensions and geometry of an antenna are typically such that the antenna is useful only within a relatively narrow band of frequencies. It is often desirable to provide an antenna capable of operating at more than one range of frequencies. However, such broadband antennas typically have less desirable gain characteristics than antennas that are designed solely for use at a narrow band of frequencies. Therefore, in order to provide acceptable gain at a variety of frequency bands, devices have been provided with multiple antennas. Although such an approach is capable of providing high gain at multiple frequencies, the provision of multiple antennas requires relatively large amounts of physical space.

An example of a device in which relatively high levels of gain at multiple frequencies and a small antenna area are desirable are wireless telephones capable of operating in connection with different wireless communication technologies. In particular, it may be desirable to provide a wireless telephone capable of operating in connection with different wireless systems having different frequencies, when communication using a preferred system is not available. Furthermore, in wireless telephones, a typical requirement is that the telephone provide high gain, in order to allow the physical size and power consumption requirements of the telephone components to be small.

Another example of a device in which high gain characteristics at multiple frequencies and a small antenna area are desirable are global positioning system (GPS) receivers. In particular, GPS receivers using dual frequency technologies, or using differential GPS techniques, must be capable of receiving weak signals transmitted on two different carrier signals. As in the example of wireless telephones, it is generally desirable to provide GPS receivers that are physically small, and that have relatively low power consumption requirements.

Still another example of a device in which a relatively high gain at multiple frequency bands is desirable is in connection with a communications satellite or a global positioning system satellite. In such applications, it can be advantageous to provide phased array antennas capable of providing multiple operating frequencies and of directing their beam towards a particular area of the Earth. In addition, it can be advantageous to provide such capabilities in a minimal area, to avoid the need for large and complex radiator structures.

Planar microstrip antennas have been utilized in connection with various devices. However, providing multiple frequency capabilities typically requires that the area devoted to the antenna double (i.e., two separate antennas must be provided) as compared to a single frequency antenna. Alternatively, microstrip antenna elements optimized for operation at a first frequency have been positioned in a plane overlaying a plane containing microstrip antenna elements adapted for operation at a second frequency. Although such devices are capable of providing multiple frequency capabilities, they require relatively large surfaces or volumes, and are therefore disadvantageous when used in connection with portable devices. In addition, such arrangements can be expensive to manufacture, and can have undesirable interference and gain characteristics.

The amount of space required by an antenna is particularly apparent in connection with phased array antennas. Phased array antennas typically include a number of radiator elements arrayed in a plane. The elements can be provided with differentially delayed versions of a signal, to steer the beam of the antenna. The steering, or scanning, of an antenna's beam is useful in applications in which it is desirable to point the beam of the antenna in a particular direction, such as where a radio communications link is established between two points, or where information regarding the direction of a target object is desired. The elements comprising phased array antennas usually must be spread over a relatively large area. Furthermore, in order to provide phased array antennas capable of operating at two different frequency bands, two separate arrays must be provided. Therefore, a conventional phased array antenna for operation at two different frequency bands can require twice the area of a single frequency band array antenna, and the phase centers of the separate arrays are not co-located. Alternatively, arrays can be stacked one on top of the other, however this approach results in antennas that are difficult to design such that they operate efficiently, and are expensive to manufacture. In addition, prior attempts at providing antenna arrays capable of operating at two distinct frequency bands have resulted in poor performance, including the creation of grating lobes, large amounts of coupling, large losses, and have required relatively large areas.

Therefore, there is a need for an antenna capable of operating at multiple frequencies that is relatively compact and that occupies a relatively small surface area. In addition, there is a need for such an antenna capable of providing a beam having high gain at multiple frequencies that can be scanned. Moreover, there is a need for an antenna capable of providing high gain at multiple frequencies that can be packaged within a relatively small area or volume, and that minimizes coupling and losses due to the close proximity of the antenna elements. Furthermore, it would be advantageous to provide an antenna capable of operating at multiple frequency bands and having co-located phase centers. In addition, such an antenna should be reliable and inexpensive to manufacture.

SUMMARY OF THE INVENTION

In accordance with the present invention, a dual band, coplanar, microstrip, interlaced array antenna is provided. The antenna includes a first plurality of antenna radiator elements forming a first array for operation at a first center frequency, interlaced with a second plurality of antenna radiator elements forming a second array for operation at a second center frequency. The antenna is capable of providing high gain in both the first and second center frequencies. In addition, the antenna may be designed to provide a desired scan range for each of the operating frequency bands.

In accordance with an embodiment of the present invention, the first and second pluralities of antenna radiator elements are located within a common plane. In addition, radiator elements adapted for use in connection with the first operating frequency band may be interlaced with radiator elements adapted for operation at the second operating frequency band. Accordingly, the footprint or area of the first antenna array may substantially overlap with the footprint or area of the second antenna array. Therefore, a dual band array antenna may be provided within an area about equal to the area of a single band array antenna having comparable performance at one of the operating frequencies of the dual band antenna.

In accordance with an embodiment of the present invention, a dual band, coplanar, microstrip array antenna is formed using metallic radiator elements. Radiator elements for operation at a first operating frequency band of the antenna are provided in a first size, and overlay a substrate having a first dielectric constant. Radiator elements for operation in connection with the second operating frequency band of the antenna are provided in a second size, and are positioned over a substrate having a second dielectric constant. The radiator elements may be arranged in separate rectangular lattice formations to form first and second arrays. The elements of the first and second arrays are interlaced so that the resulting dual band antenna occupies less area than the total area of the first and second arrays would occupy were their respective radiator elements not interlaced.

In accordance with still another embodiment of the present invention, a method for providing a dual frequency band antenna apparatus is provided. According to such a method, first and second center frequencies are selected. In addition, a scan range for the first center frequency and a scan range for the second center frequency are selected. From the wavelength corresponding to the first center frequency and the scan range for that first center frequency a lattice spacing for a first plurality of radiator elements is determined. The lattice spacing is the center to center spacing between radiator elements within an array of elements. Similarly, a lattice spacing for a second plurality of radiator elements is determined from the wavelength corresponding to the second center frequency and the scan range for the second center frequency. The maximum lattice spacing is the smaller of the lattice spacings for the first or second plurality of radiator elements. Where the scan range of one or both arrays is a first value in a first dimension and a second value in a second dimension, lattice spacing calculations may be made for each dimension.

A dielectric constant for a first substrate as a function of the wavelength of the first center frequency and the maximum lattice spacing may then be selected. The dielectric constant for the first substrate should have a value that is no less than 1.0. The dielectric constant for a second substrate may then be calculated as a function of the first substrate dielectric constant, the first center frequency, and the second center frequency. Next, an effective size of the radiator elements in the first plurality of radiator elements and of the radiator elements in the second plurality of radiator elements can be calculated as a function of the wavelength of the operative center frequency and the corresponding dielectric constant of the substrate. A physical size of the first radiator elements and of the second radiator elements can then be calculated.

In accordance with a further embodiment of the present invention, a first plurality of radiator elements are formed on dielectric material having a dielectric constant equal to the first dielectric constant calculated according to the method. In addition, the second plurality of radiator elements is formed on dielectric material having a dielectric constant equal to the second dielectric constant. A first array may then be formed from the first plurality of radiator elements. The radiator elements of the first array are arranged about a rectangular lattice and have a center to center spacing equal to the calculated maximum lattice spacing. Similarly, a second array is formed from the second plurality of radiator elements. The radiator elements of the second array are arranged about a rectangular lattice and have a center to center spacing equal to the calculated maximum lattice spacing. The first array is then interlaced with the second array. Accordingly, a dual band antenna occupying a reduced surface area may be provided.

In accordance with another embodiment of the present invention, a method for modifying the effective dielectric constant of a material is provided. According to the method, portions of a material may be relieved, for example by forming holes in the material, in an area in which a modified (i.e. reduced) dielectric constant is desired. According to an embodiment of the present invention, a modified effective dielectric constant is obtained by forming holes in a triangular lattice pattern in an area of a dielectric material in which a reduced effective dielectric constant is desired. In accordance with yet another embodiment of the present invention, a material having a modified effective dielectric constant is provided.

Based on the foregoing summary, a number of salient features of the present invention are readily discerned. A dual band antenna that allows for the scanning of the two center frequencies is provided. The antenna further allows for the provision of a dual band scanning antenna apparatus occupying a reduced surface area. The antenna allows support of both center frequencies with minimal or no grating lobes and minimal coupling. The antenna may be formed from two, co-planar, interlaced arrays. Furthermore, the present invention allows the provision of a dual band scanning antenna that occupies a reduced surface area, that provides a desired scan range of the operative frequencies and in which a desired amount of directivity is provided.

In addition, a material having a modified effective dielectric constant, and a method for modifying the effective dielectric constant of a material, are provided.

Additional advantages of the present invention will become readily apparent from the following discussion, particularly when taken together with the accompanying drawings.

BRIEF DESCRIPTION OF THE DRAWINGS

FIG. 1A is a plan view of a dual band array antenna in accordance with an embodiment of the present invention;

FIG. 1B is a side elevation of the antenna of FIG. 1A;

FIG. 1C is a plan view of the back side of the antenna of FIG. 1A;

DETAILED DESCRIPTION

Figure 2:
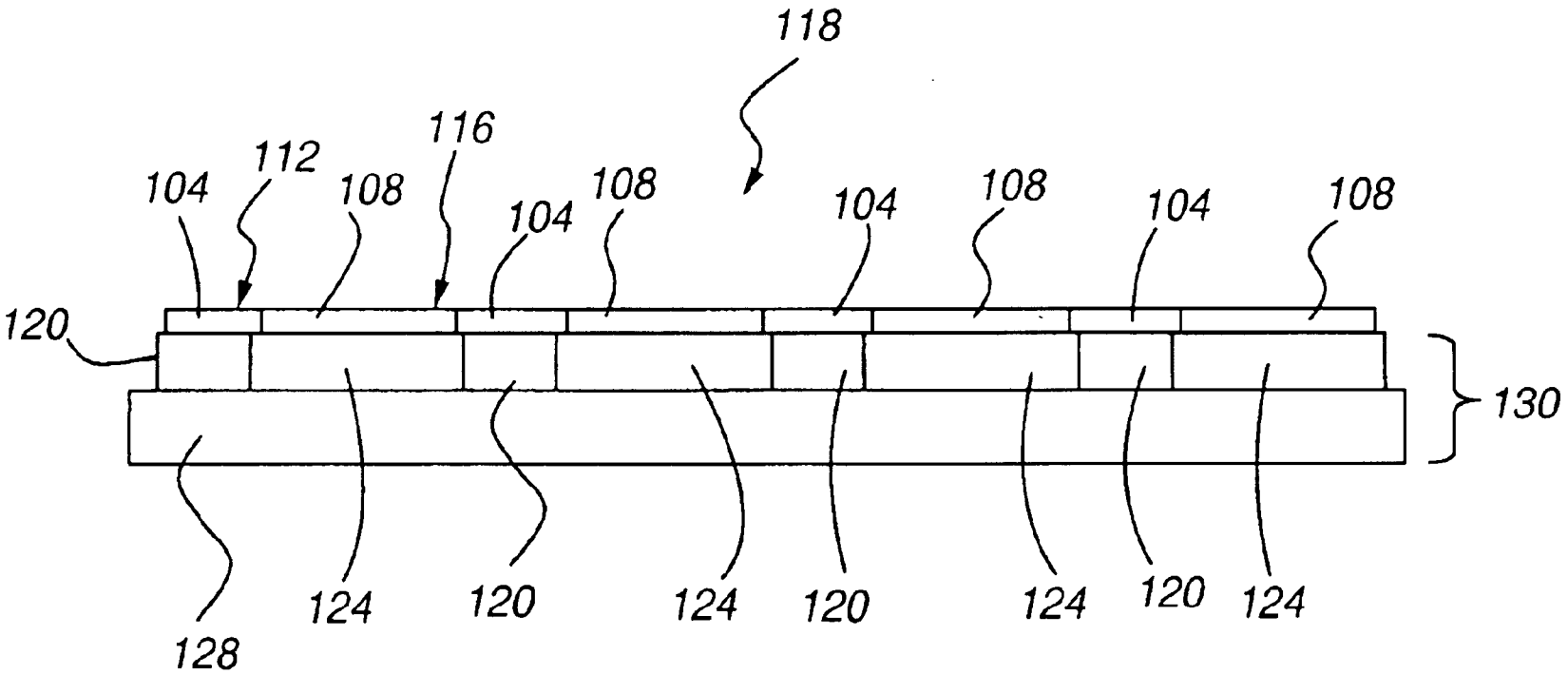
FIG. 2 is a side elevation of the radiator assembly of the antenna of FIGS. 1A–1C.

In accordance with the present invention, dual band array antennas and methods for providing dual band antennas are disclosed.

With reference now to FIG. 1A, a dual band array antenna 100 in accordance with an embodiment of the present invention is illustrated in plan view. In general, the antenna 100 comprises a first plurality of radiator elements 104 for operation at a first operating or center frequency $f_1$, and a second plurality of radiator elements 108 for operation at a second operating or center frequency $f_2$. The first plurality of radiator elements 104 are arranged about a rectangular lattice, with a center to center spacing equal to $L_{max}$, which is determined as will be described in greater detail below. Similarly, the second plurality of radiator elements 108 are arranged to form a second array arranged about a rectangular lattice in which the center to center spacing of the elements is also equal to $L_{max}$. The radiator elements 104, 108 may be formed on a substrate assembly 130, as will be explained in greater detail below.

With reference now to FIG. 1B, the antenna system 100 of FIG. 1A is shown in a side elevation. As shown in FIG. 1B, the antenna system 100 may be considered as a radiator assembly 118, generally comprising the substrate assembly 130 and the radiator elements 104, 108, and a feed network 140.

The feed network 140 is best illustrated in FIG. 1C, which depicts a side of the antenna system 100 opposite the side illustrated in FIG. 1A. In general, the feed network 140 comprises signal amplifiers and phase shifters, housed in enclosures 144, and signal feed lines 148. Certain of the feed lines 148 interconnect the radiator elements 104, 108 to the amplifiers housed in the enclosures 144. By positioning the amplifiers and phase shifters in close proximity to the radiator elements 104, 108, the antenna system 100 illustrated in FIGS. 1A–1C avoids the losses incurred from power divider circuits. Accordingly, the antenna system 100 illustrated in FIGS. 1A–1C may be understood to be an active antenna system.

In addition, it should be appreciated that the feed lines 148 for passing signals between the radiator elements 104, 108 and corresponding amplifiers and phase shifters within the enclosures 144 may be interconnected to the radiator elements 104, 108 at one or a number of points. For example, as shown in FIG. 1A, feed lines 148 may be interconnected to radiator elements 104, 108 at two separate feed points 152. In general, where the antenna system 100 is circularly polarized, the signal is provided from a single amplifier over a feed line 148. A portion of that signal is then passed through a hybrid, such that the phase of the signal provided at a first feed point 152 is 90 degrees from the phase of the signal provided at the second feed point 156. Furthermore, as can be appreciated by one of ordinary skill in the art, hybrids providing additional phase shifts may be used in connection with a greater number of feed points. For instance, when four feed points are provided on a radiator element, spaced 90 degrees apart about the element, hybrids capable of phase shifting the signal by 90, 180, and 270 degrees with respect to the signal provided to a first of the feed points may be used.

In accordance with yet another embodiment of the present invention, a dedicated amplifier is provided for supplying a properly phased signal to each feed point associated with a radiator element 104 or 108. According to such an embodiment, an antenna system 100, such as the one illustrated in FIGS. 1A–1C would include two amplifiers for each radiator element 104, 108. Similarly, an antenna system utilizing more (e.g., four) feed points would utilize a greater number (e.g., four) amplifiers in connection with each radiator element 104, 108. According to such an embodiment, the use of hybrids interposed between an amplifier and the radiator elements 104, 108 can be avoided. Such embodiments allow a large number of relatively small amplifiers to be used, and can increase the efficiency of the antenna system 100 as compared to systems in which hybrid circuits and/or power divider circuits are interposed between the amplifiers and the radiator elements 104, 108.

As can be appreciated by one of ordinary skill in the art, the number of feed points that may be used in connection with a particular radiator element 104, 108 depends, at least in part, on the geometry of the radiator element 104, 108. For instance, in connection with a circular radiator element 104, 108, one, two or four feed points are typically used. Similarly, in connection with a square radiator element, one, two or four feed points may typically be used. Radiator elements having dipole configurations typically may use one or two feed points. The increased efficiency provided by the use of one or more amplifiers for each feed point is particularly advantageous in connection with applications involving the transmission of high-powered signals, or the reception of relatively small signals.

With reference now to FIG. 2, the radiator assembly 118 of FIGS. 1A–1C is shown in detail in a side elevation. From FIG. 2 it can be appreciated that the radiator elements 104 of the first array 112 are formed or mounted on a first dielectric material or substrate 120. The first dielectric material 120 has a first dielectric constant ($er_1$), calculated as will be explained in detail below. Similarly, the radiator elements 108 of the second array 116 are formed or mounted on a second dielectric material or substrate 124 having a second dielectric constant ($er_2$), calculated as will also be explained in detail below. The first 120 and second 124 dielectric materials may in turn be formed or attached to a conductive ground plane 128. The first dielectric material 120, the second dielectric material 124 and the ground plane 128 comprise the substrate assembly 130. Furthermore, the radiator elements 104, 108 may be substantially coplanar in that they are interconnected to a common substrate assembly 130. According to an embodiment of the present invention, the first plurality of radiator elements 104 may be situated in a first plane that is coplanar or substantially coplanar with a second plane in which the second plurality of radiator elements 108 are situated. For instance, the first dielectric material 120 associated with the first plurality of radiator elements 104 may be a first thickness, and the second dielectric material 124 associated with the second plurality of radiator elements 108 may be a second thickness, placing the first 104 and second 108 radiator elements in different planes. As a further example, the first and second planes may be within a distance equal to a thickness of at least one of the first 104 or second 108 radiator elements.

In accordance with an embodiment of the present invention, the radiator elements 104 and 108 comprise electrically conductive microstrip patches. The dielectric substrates 120 and 124 may be formed from any dielectric material having the required dielectric constant. For example, the second dielectric material 124 may be a DUROID material with a dielectric constant of 2.33 and the first dielectric material 120 may be a DUROID material, modified as explained below, to have a dielectric constant of 1.5. In addition, one or both of the dielectric materials 120, 124 may be found from air, in which case the radiator elements 104 and/or 108 may be held in position over the ground plane by dielectric posts. The ground plane 128 may be any electrically conductive material. For example, the ground plane 128 may be metal. In general, any substrate assembly 130 configuration that provides a backing or a substrate for the first radiator elements 104 having a first dielectric constant ($er_1$) and a backing or a substrate for the second radiator elements 108 having a second dielectric constant ($er_2$) may be utilized in connection with the present invention. Furthermore, it should be appreciated that the first 120 and second 124 dielectric substrates may be formed from a common piece of material (i.e. the dielectric substrates 120, 124 may be integral to one another). According to such an embodiment, the dielectric constant in areas adjacent the first plurality of radiator elements 104 may be modified as compared to the dielectric constant in areas adjacent the second plurality of radiator elements 108, or vice versa. In addition, it should be appreciated that a material may be modified to have a first dielectric constant ($er_1$) value in areas adjacent the first plurality of radiator elements 104 and may be modified to have a second dielectric constant ($er_2$) value in areas adjacent the second plurality of radiator elements 108. The effective dielectric constant value of a material may be modified by using composite materials, or by forming holes in a dielectric material, as will be explained in detail below.

With continued reference to FIG. 1, the antenna 100 can be seen to comprise circular radiator elements 104 and 108. In addition, it can be seen that each of the arrays 112 and 116 formed from the radiator elements 104 and 108 contains an equal number of radiator elements 104 or 108. Of course, it is not necessary that the arrays 112 and 116 have an equal number of elements. Also with reference to FIG. 1, it can be appreciated that an overall area occupied by the first array 112, denoted by dotted line 132 in FIG. 1, substantially overlaps with an overall area occupied by the second array 116, denoted by dotted line 136 in FIG. 1. This overlap is achieved by interlacing the elements 104 of the first array 112 with the elements 108 of the second array 116. Accordingly, an antenna 100 providing arrays 112 and 116 having different operating frequencies can be provided within an area that is substantially equal to an area of either the first array 112 or the second array 116 alone. Furthermore, the antenna 100 provides dual band capabilities in a relatively small surface area without the formation of undesirable grating lobes, and while providing a desired scan range and directivity.

As can be appreciated by one of ordinary skill in the art, the size of the arrays 112, 116 (i.e. the area occupied by the arrays 112, 116) is determined by the required beamwidth and the frequency of operation. In general, a narrow beam requires a larger array size and hence a larger number of elements. The converse is true for a broader beam. Also, for a given beamwidth, a physically larger array is required at a lower frequency than at a higher frequency. Furthermore, it can be appreciated that the arrays (or apertures) may be partially populated to realize the desired beamwidths at each of the operating frequencies.

Figure 3:
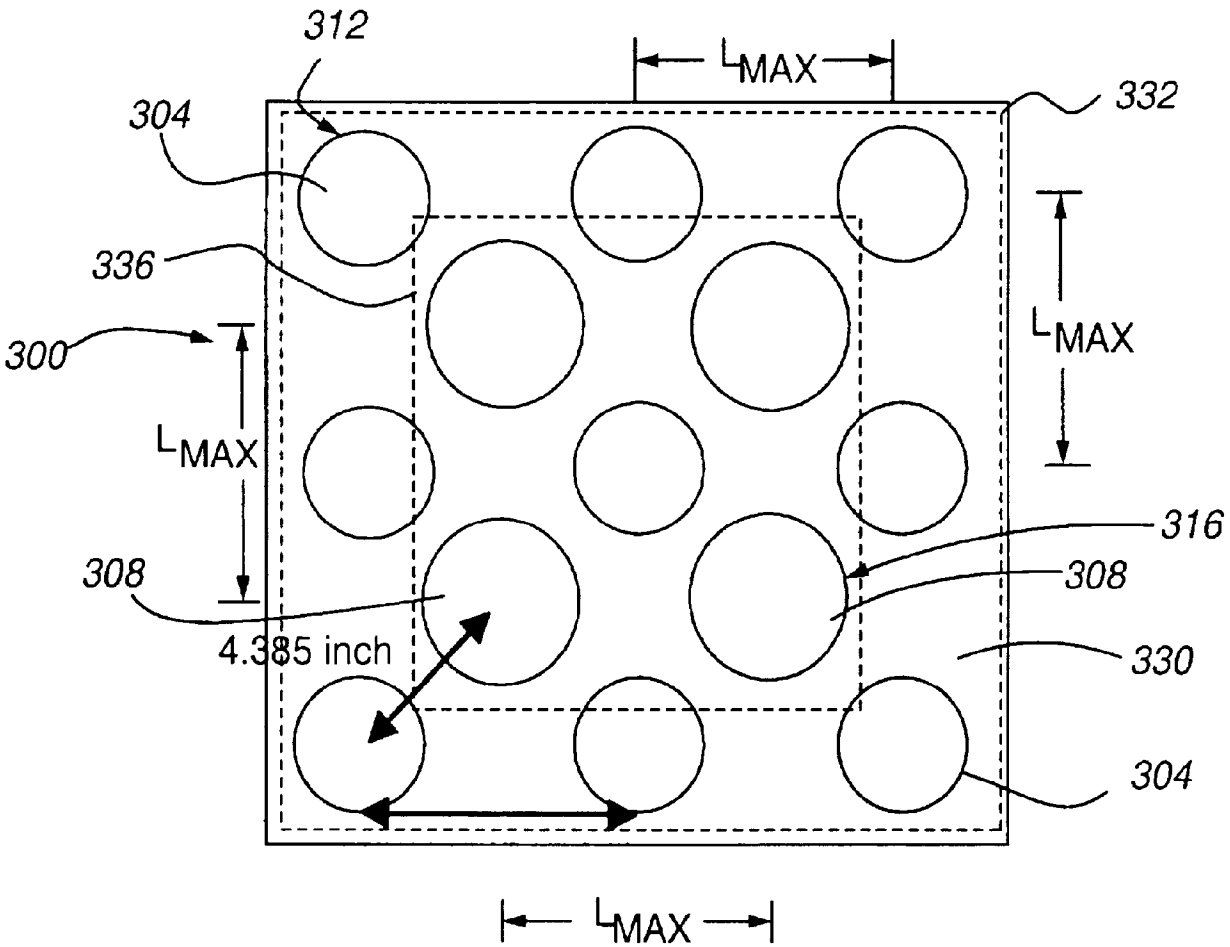
FIG. 3 is a plan view of a dual band array antenna in accordance with another embodiment of the present invention.

With reference now to FIG. 3, a dual band antenna 300 in accordance with another embodiment of the present invention is illustrated. In general, the antenna 300 includes a first plurality of radiator elements 304 for operation at a first operating or center frequency $f_1$, and a second plurality of radiator elements 308 for operation at a second operating or center frequency $f_2$. As in the antenna system 100 shown in FIG. 1, the antenna 300 of FIG. 3 comprises radiator elements 304 and 308 formed from circular patches. Also as in the antenna 100 of FIG. 1, the antenna 300 in FIG. 3 features a first array 312 formed from the first plurality of radiator elements 304, arranged about a rectangular lattice, and with a center to center spacing of the radiator elements 304 that is equal to $L_{max}$. The antenna 300 also includes a second array 316 formed from the second plurality of radiator elements 308. The second array 316 includes elements spaced along a rectangular lattice and having a center to center spacing between elements 308 equal to $L_{max}$. The first and second arrays 312, 316 may be interconnected to one another by a substrate assembly 330 that provides a first dielectric constant adjacent the first radiator elements 304, a second dielectric constant adjacent the second radiator elements 308, and a common ground plane.

The first array 312 of the antenna 300 includes nine radiator elements 304 occupying a first area, denoted by dotted line 332 in FIG. 3. The second array 316 includes four radiator elements 308 occupying a second area, denoted by dotted line 336. As can be appreciated from FIG. 3, the elements 304 of the first array are interlaced with the elements 308 of the second array 316, such that the area 336 occupied by the second array 316 substantially overlaps with the area 332 occupied by the first array 312. Furthermore, it can be appreciated that the areas 332, 336 of the first 312 and the second 316 arrays are centered about the same point.

Figure 4:
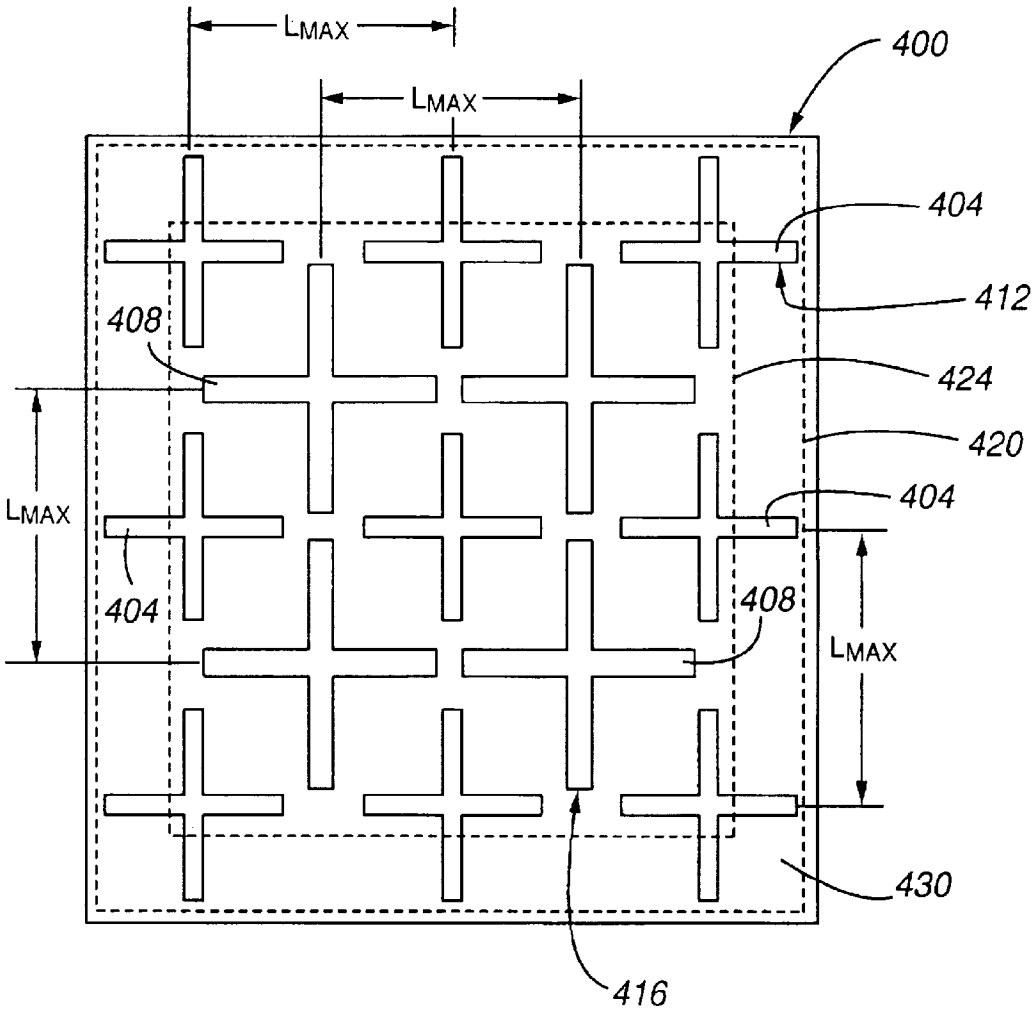
FIG. 4 is a plan view of a dual band array antenna having dipole radiator elements in accordance with an embodiment of the present invention.

In FIG. 4, a dual band antenna 400 in accordance with still another embodiment of the present invention is illustrated. In general, the antenna 400 includes a first plurality of radiator elements 404 for operation at a first operating or center frequency $f_1$, and a second plurality of radiator elements 408 for operation at a second operating or center frequency $f_2$. In the antenna 400 depicted in FIG. 4, a first array 412 is formed from the first plurality of radiator elements 404. The radiator elements 404 of the first array 412 are arranged about a rectangular lattice and have a center to center spacing equal to $L_{max}$. A second array 416 is formed from the second plurality of radiator elements 408. The radiator elements 408 of the second array 416 are arranged about a rectangular lattice, and have a center to center spacing that is also equal to $L_{max}$. The radiator elements 404, 408 in the embodiment shown in FIG. 4 have a dipole configuration. Therefore, it can be appreciated that various radiator configurations may be used in connection with the present invention.

The first array 412 of the antenna 400 includes nine radiator elements 404 occupying a first area, denoted by dotted line 420 in FIG. 4. The second array 416 includes four radiator elements 408 occupying a second area, denoted by dotted line 424. As can be appreciated from FIG. 4, the elements 404 of the first array 412 are interlaced with the elements 408 of the second array 416, such that all of the area 424 occupied by the second array 416 is included in the area 420 occupied by the first array 412. Therefore, it can be appreciated that the first 412 and second 416 arrays occupy areas 420, 424 that substantially overlap. This overlap of the first 412 and second 416 arrays substantially decreases the surface area required by an antenna having the operating characteristics of the antenna 400.

The radiator elements 404, 408 may be located in common plane, formed on a substrate assembly 430 that provides a first dielectric constant with respect to the first radiator elements 404, a second dielectric constant with respect to the second radiator elements 408, and a common ground plane. In addition to the relatively small surface area required by the dual band antenna 400, it will be noted that the areas 420, 424 occupied by the arrays 412, 416 share a common center point. Accordingly, the arrays 412, 416 of the antenna 400 provide co-located phase centers.

Figure 5:
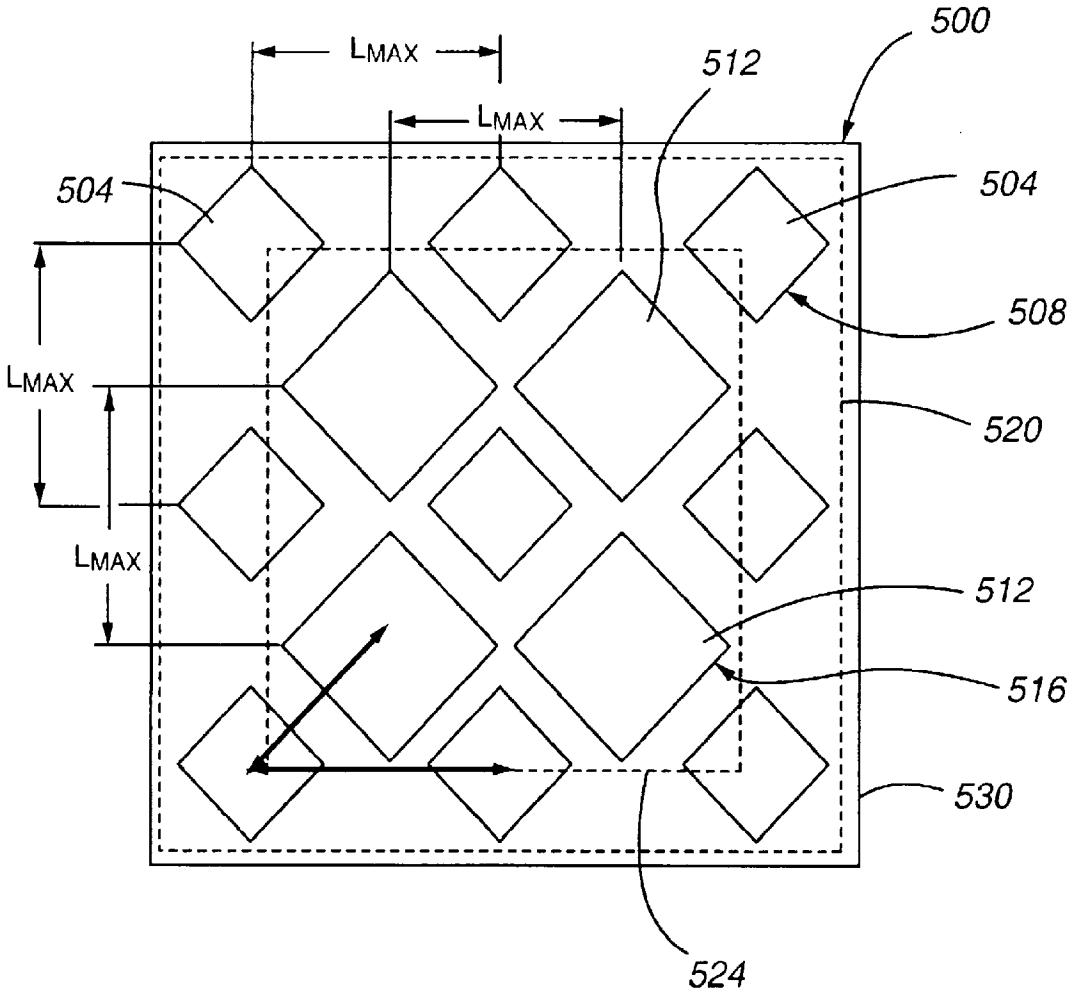
FIG. 5 is a plan view of a dual band array antenna having rectangular radiator elements in accordance with an embodiment of the present invention.

With reference now to FIG. 5, a dual band antenna 500 in accordance with still another embodiment of the present invention is illustrated. In general, the antenna 500 includes a first plurality of radiator elements 504, forming a first array 508 for operating at a first operating or center frequency $f_1$. In addition, a second plurality of radiator elements 512 are provided, forming a second array 516 for operating at a second operating or center frequency $f_2$. Each of the elements 504, 512 of the first 508 and second 516 arrays are arranged about rectangular lattices and have a center to center spacing with respect to other elements of their respective array equal to $L_{max}$.

The elements 504, 512 of the dual band antenna 500 illustrated in FIG. 5 are square in outline. In addition, the sides of the radiator elements 504, 512 are angled with respect to the sides of the rectangular lattice about which the radiator elements 504, 512 are positioned. The first array 508 is formed from nine radiator elements 504 occupying a first area denoted by dotted line 520. The second array 516 includes four radiator elements 512 occupying a second area denoted by dotted line 524. From FIG. 5, it can be appreciated that the first area 520 includes all of the second area of 524. Furthermore, it can be appreciated that the second array 516 is centered with respect to the first array 508. Accordingly, the first 508 and second 516 arrays of the antenna 500 have co-located phase centers. The first 508 and 516 arrays may be formed on a substrate assembly 530 that provides a first dielectic constant with respect to the first plurality of radiator elements 508, a second dielectric constant with respect to the second plurality of radiator elements 512, and a common ground plane.

Figure 6:
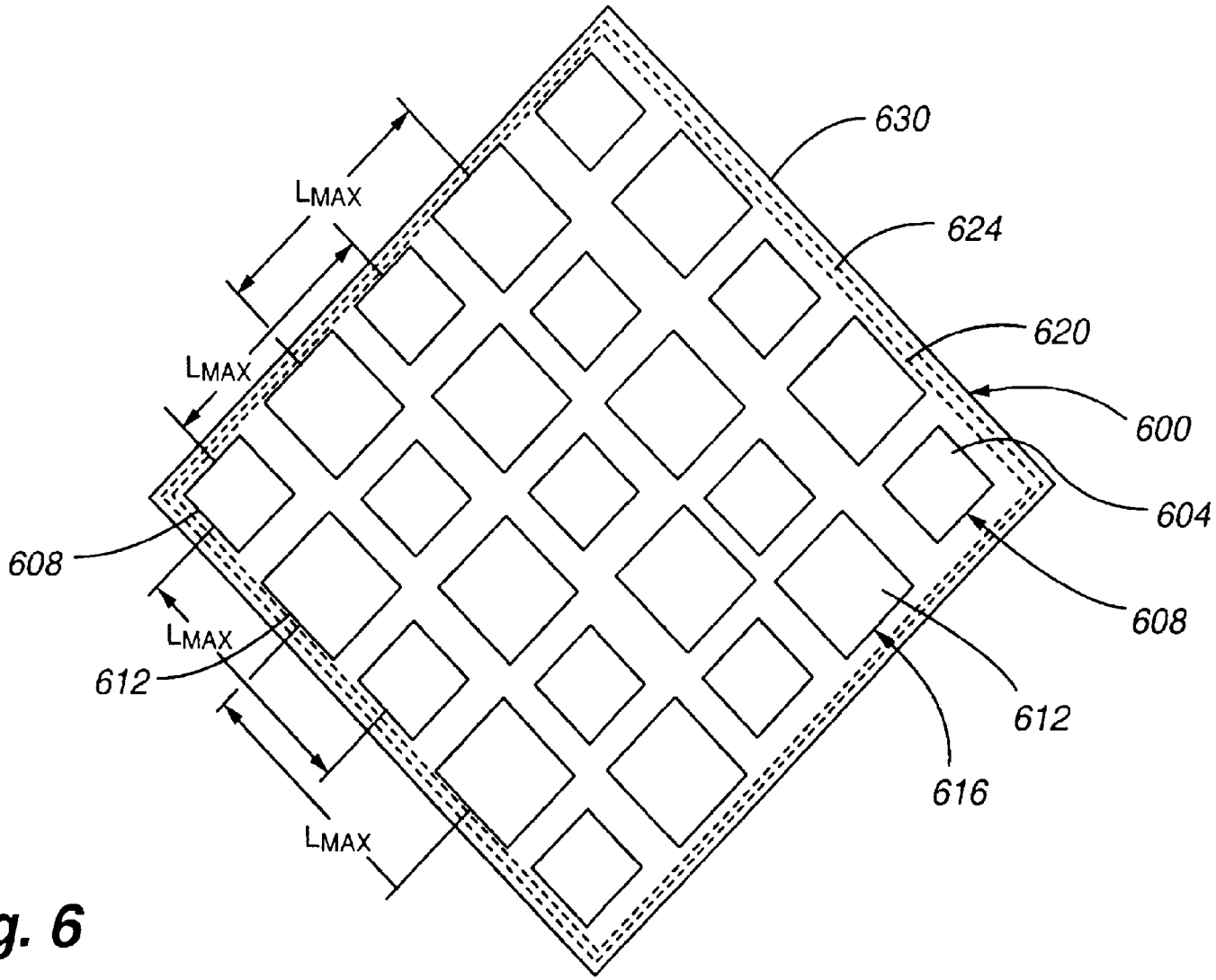
FIG. 6 is a plan view of a dual band array antenna having rectangular radiator elements in accordance with another embodiment of the present invention.

In FIG. 6, a dual band antenna 600 in accordance with still another embodiment of the present invention is illustrated. In general, the antenna 600 includes a first plurality of square radiator elements 604, forming a first array 608 for operation at a first operating or center frequency $f_1$. The antenna 600 additionally includes a second plurality of square radiator elements 612 forming a second array 616 for operation at a second operating or center frequency $f_2$. The radiator elements 604 of the first array 608 are arranged about a rectangular lattice and are spaced from one another by a distance equal to $L_{max}$. Similarly, the second radiator elements 612 are spaced about a rectangular lattice and have a center to center distance from one another that is also equal to $L_{max}$. The elements 604 of the first array 608 are interlaced with the elements 612 of the second array 616 to minimize the surface area occupied by the antenna 600. In particular, in FIG. 6 it is apparent that the area occupied by the first array 608, denoted by dotted line 620, is essentially the same as the area occupied by the second array 616, denoted by dotted line 624. Furthermore, it can appreciated that the areas 620, 624 share a common center point, allowing the first 608 and second 616 arrays to share a common phase center. The arrays 608, 616 may be formed on a common substrate assembly 630 providing appropriate dielectric constants, over a common ground plane.

Figure 7:
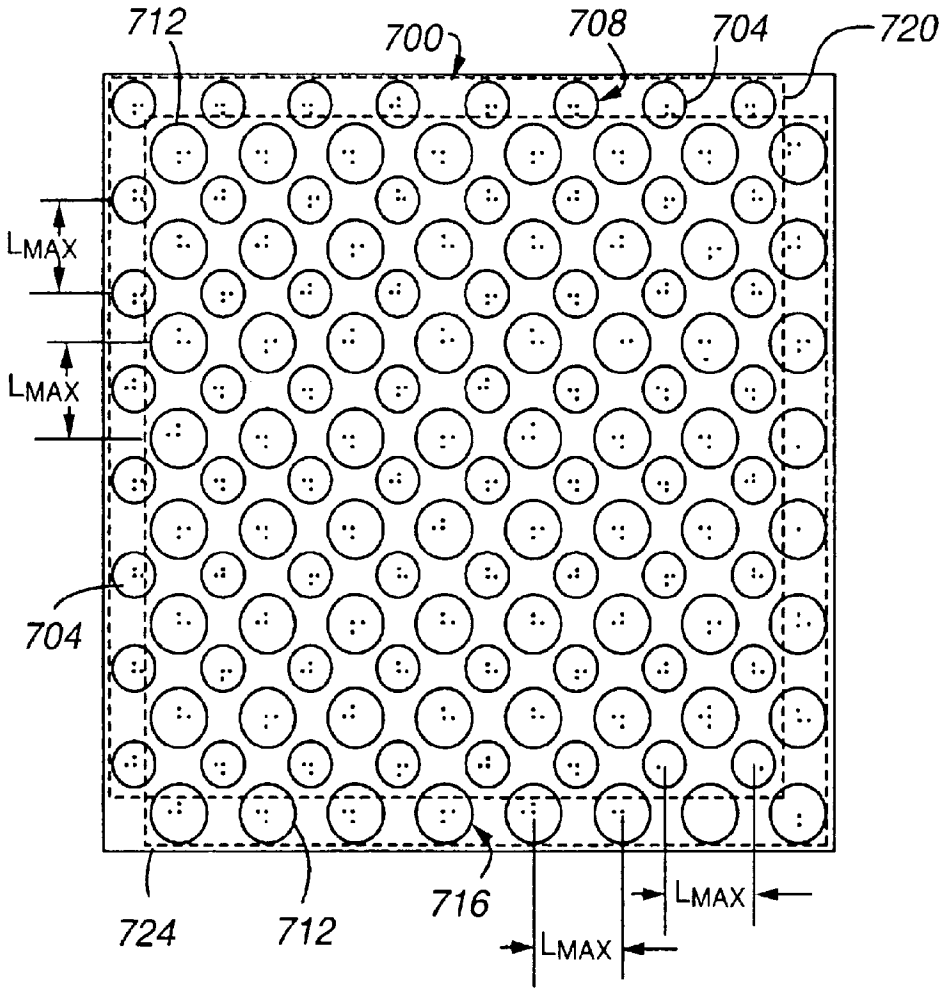
FIG. 7 is a plan view of a dual band array antenna having circular radiator elements in accordance with yet another embodiment of the present invention.

With reference now to FIG. 7, a dual band antenna 700 in accordance with still another embodiment of the present invention is illustrated. In general, the dual band antenna 700 comprises a first plurality of radiator elements 704 forming a first array 708 for operation at a first operating or center frequency $f_1$. In addition, the antenna 700 comprises a second plurality of radiator elements 712 forming a second array 716 for operation at a second operating or center frequency $f_2$. As in the embodiments illustrated in FIGS. 1 and 3, the radiator elements 704, 712 of the dual band antenna 700 are circular. The radiator elements 704 of the first array 708 are arranged about a rectangular lattice and have a center to center spacing equal to $L_{max}$. Similarly, the radiator elements 712 of the second array 716 are arranged about a rectangular lattice and have a center to center spacing equal to $L_{max}$.

In the embodiment illustrated in FIG. 7, each of the arrays 708, 716 comprises 64 radiator elements 704, 712. The radiator elements 704 comprising the first array 708 generally occupy an area denoted by dotted line 720. The radiator elements 712 comprising the second array 716 generally occupy a second area denoted by dotted line 724. The first 720 and second 724 areas substantially overlap. The arrays 708, 716 may be formed on a substrate assembly 730 that provides a first dielectric constant ($er_1$) with respect to the radiator elements 704 of the first array 708, a second dielectric constant ($er_2$) with respect to the radiator elements 712 of the second array 716, and a common ground plane.

Figure 8:
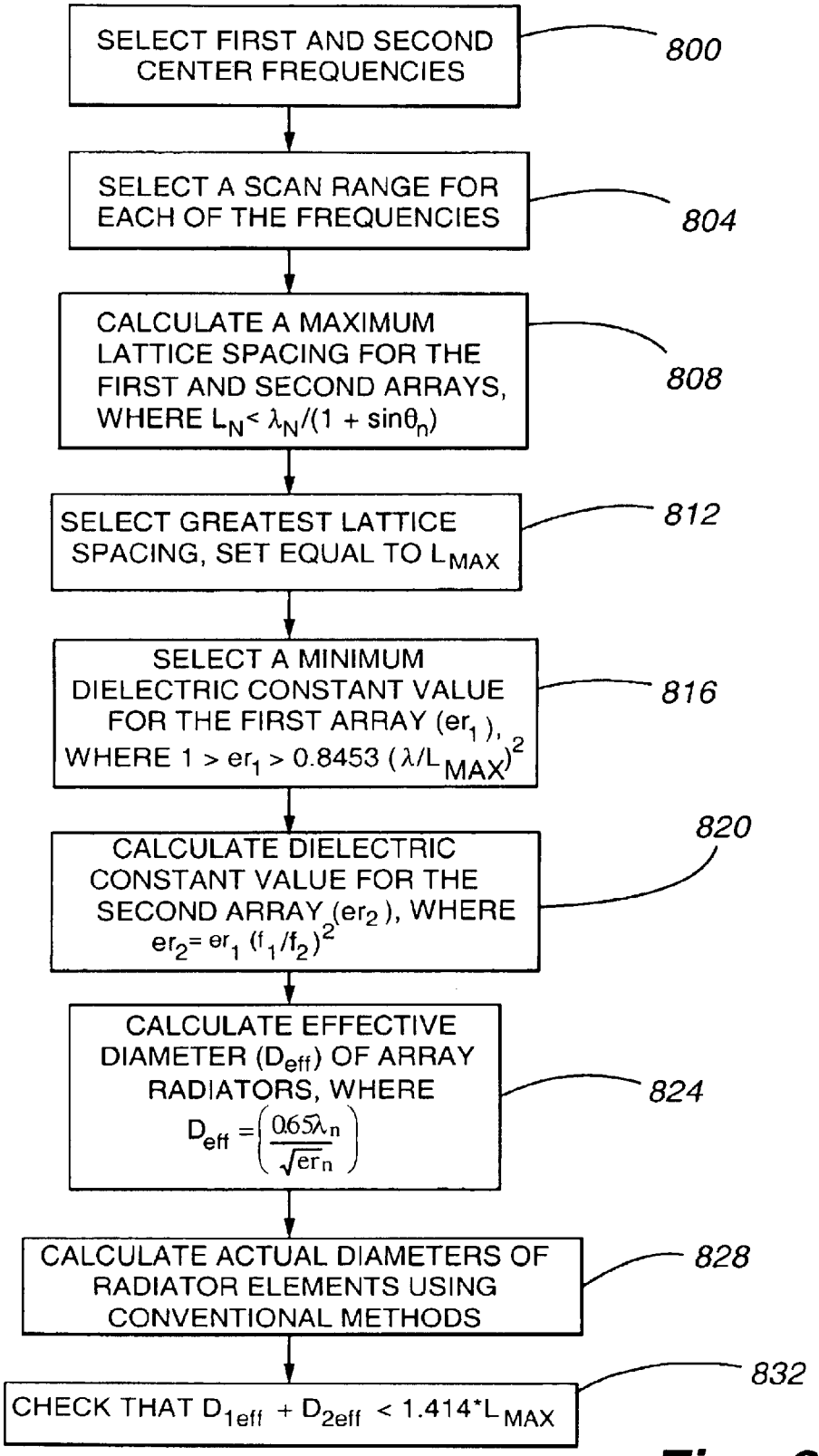
FIG. 8 is a flow chart illustrating a method of dimensioning a dual band array antenna in accordance with an embodiment of the present invention.

With reference now to FIG. 8, a flow chart illustrating a method of dimensioning a dual band array antenna in accordance with an embodiment of the present invention is shown. Initially, at step 800, the first ($f_1$) and second ($f_2$) center or operating frequencies of the dual band antenna are selected. In general, the first and second center frequencies will be determined by the system in connection with which the antenna is to be used. For example, in a global positioning system (GPS) application, an antenna for use on a GPS satellite may have a first center frequency of 1,575 Megahertz and a second center frequency of 1,227 Megahertz. Next, a scan range for each of the center frequencies is selected (step 804). Continuing the example of a GPS satellite application, the first and second center frequencies may both have a scan range of 14°.

From the selected frequency and scan range parameters, a maximum lattice spacing for the first and second arrays that will comprise the dual band antenna are calculated (step 808). In particular, the maximum lattice spacing for the first array ($L_1$) is given by $L_1<\lambda_1/(1+\sin(\theta_1))$, where $\lambda_1$ is the wavelength of the carrier signal at the first center frequency, and where $\theta_1$ is the scan range for the signal at the first center frequency. Similarly, the maximum lattice spacing for the second array ($L_2$) is given by $L_2<\lambda_2/(1+\sin(\theta_2))$, where $\lambda_2$ is the wavelength of the carrier signal at the second center frequency, and where $\theta_2$ is the scan range for the signal at the second center frequency. The maximum lattice spacing ($L_{max}$) is the largest spacing value that satisfies both the requirements for $L_1$ and the requirements for $L_2$. (Step 812).

A minimum dielectric constant value ($er_1$) for a first substrate adjacent the radiator elements of the first array is then selected. The value for $er_1$ is given by the following: $er_1>0.8453\ (\lambda_1/L_{max})^2$, where $er_1$ is also no less than 1.0. (Step 816). Once the minimum dielectric constant value for the first array has been calculated, the dielectric constant value ($er_2$) for a second substrate adjacent the radiator elements of the second array can be calculated from the equation $er_2=er_1*(f_1/f_2)^2$ (Step 820). Next, the effective diameter (D) of the radiator elements can be calculated from the equation $$D_{neff} = \left(\frac{0.65\lambda_n}{\sqrt{er_n}}\right)$$

(Step 824). Then, the actual diameters of the radiator elements may be calculated using conventional methods (step 828). A check may then be made to ensure that the effective diameters of the interlaced radiator elements will not encroach on one another at the selected lattice spacing $L_{max}$ (i.e. that $D_{1eff}+D_{2eff}<1.414*L$ for a square lattice) (Step 832). If the effective diameters of adjacent radiator elements do encroach on one another, a greater dielectric constant value ($er_1$) for the first substrate may be selected, and a new dielectric constant value ($er_2$) for the second substrate may be calculated. The effective diameters of the radiator elements may then be recalculated, and a check may again be made to ensure that the effective diameters of the radiator elements do not encroach on one another.

As can be appreciated by one of ordinary skill in the art, a phased array antenna may be scanned in two dimensions. For antennas in which the scan range for both arrays is the same in both dimensions, the value obtained for $L_{max}$ is also the same in both dimensions. Furthermore, it can be appreciated that the rectangular lattice spacing obtained for the radiator elements results in a square lattice when the scan ranges in two dimensions are the same.

If different scan ranges are desired for the two dimensions, separate calculations are made for the element spacing in each of the two dimensions. That is a maximum element spacing for the first array in the x dimension $L_{1x}$, a maximum element spacing for the first array in the y dimension $L_{1y}$, a maximum element spacing for the second array in the x dimension $L_{2x}$, and a maximum element spacing for the second array in y dimension $L_{2y}$ are calculated. The smaller of the $L_{1x}$ and $L_{2x}$ is then selected as $L_{maxx}$ (i.e. the maximum lattice spacing the x dimension), and the smaller of $L_{1y}$ and $L_{2y}$ is selected as $L_{maxy}$ (i.e. the maximum lattice spacing in y dimension). As can be appreciated, an antenna in accordance with the present invention having different scan ranges in two dimensions may therefore have a rectangular lattice spacing that is not square.

As can also be appreciated, the scan ranges for the first and second array need not be equal. Therefore, as many as four different scan ranges may be associated with an antenna in accordance with the present invention.

Where different lattice spacings are used for the x and y dimensions, a different check must be made to ensure that the effective diameters of the interlaced radiator elements will not encroach on one another. In particular, the inequality $$D_{1eff} + D_{2eff} < \sqrt{L_1^2 + L_2^2}$$

must be satisfied.

The method disclosed herein for dimensioning a dual band array antenna allows radiator elements of the first and second arrays to be interlaced with one another to minimize the surface area occupied by the antenna. In addition, the disclosed method provides a dual band antenna with interlaced arrays with minimal or no grating lobes or losses, such as can occur when large distances separate radiator elements of an array. The disclosed method for dimensioning a dual band antenna also results in minimal coupling and losses at the operating frequencies that might otherwise be caused by the close proximity of the radiator elements of the two arrays. Furthermore, the electrical spacing between the radiator elements is optimized by providing proper dielectric loading of the radiator elements.

Figure 9:
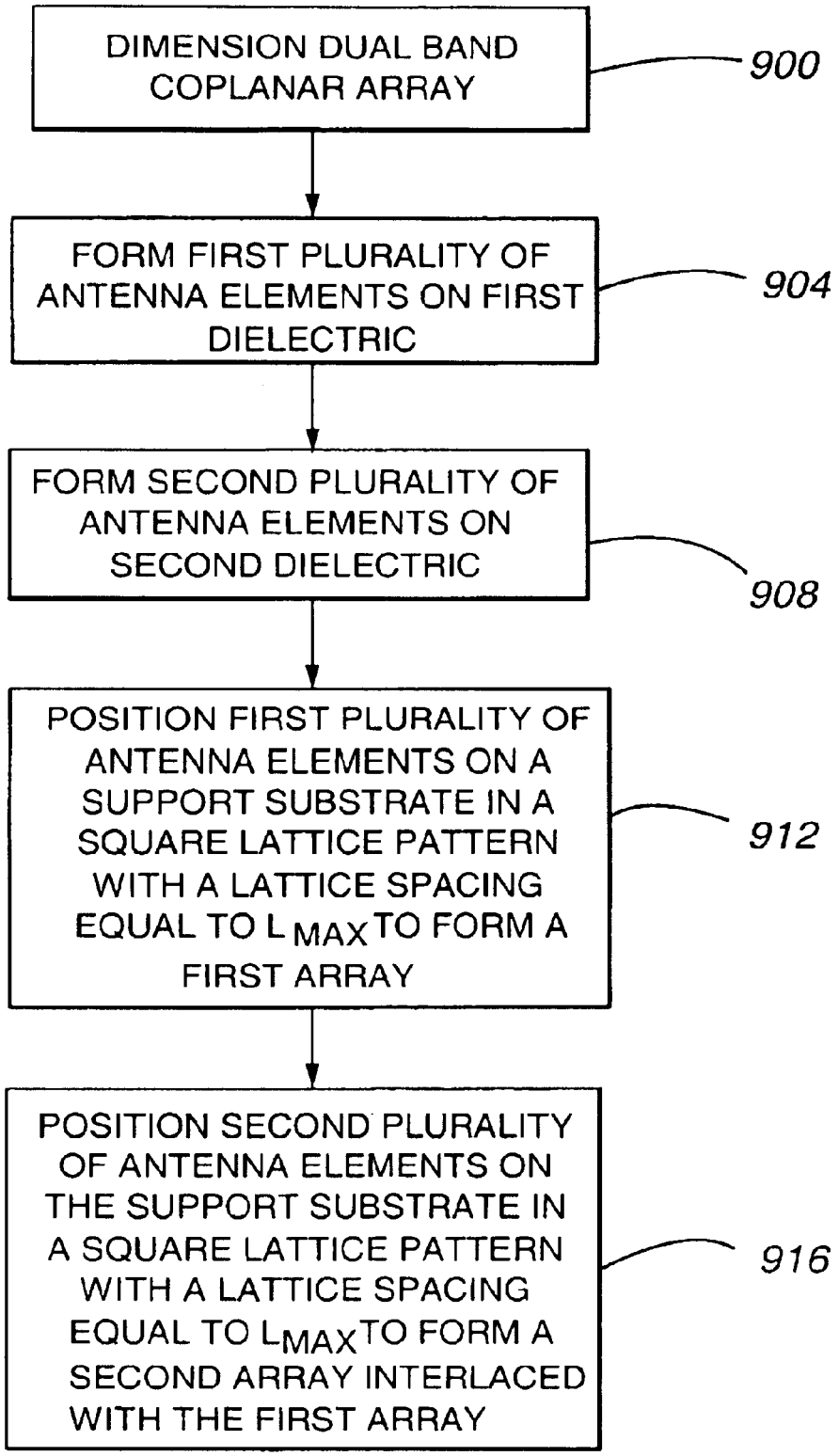
FIG. 9 is a flow chart illustrating the manufacture of a dual band array antenna in accordance with an embodiment of the present invention.
Figure 10A:
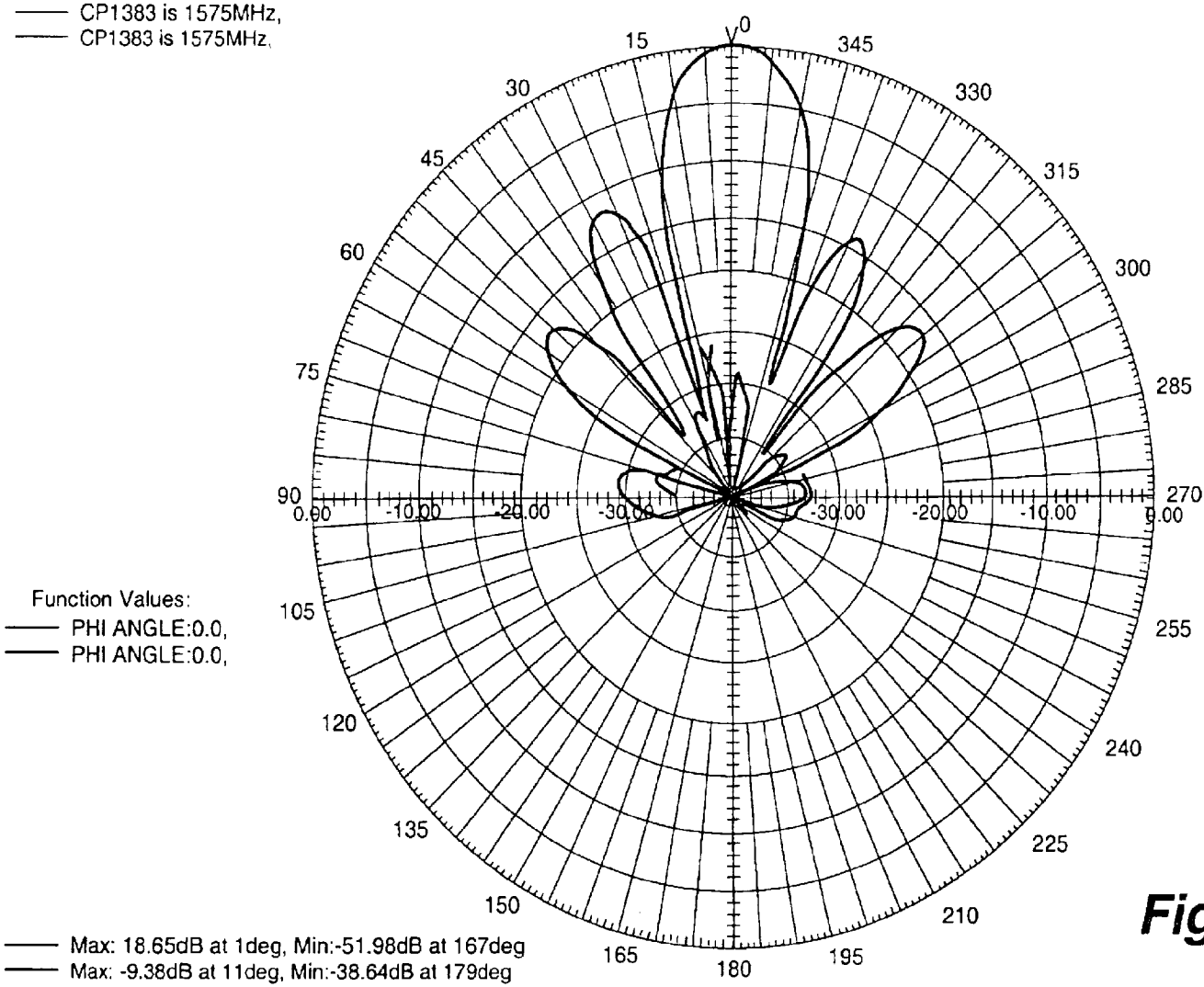
FIGS. 10A–10D illustrate radiation patterns produced by a first array of a dual band array antenna operating at a first frequency in accordance with an embodiment of the present invention.
Figure 10B:
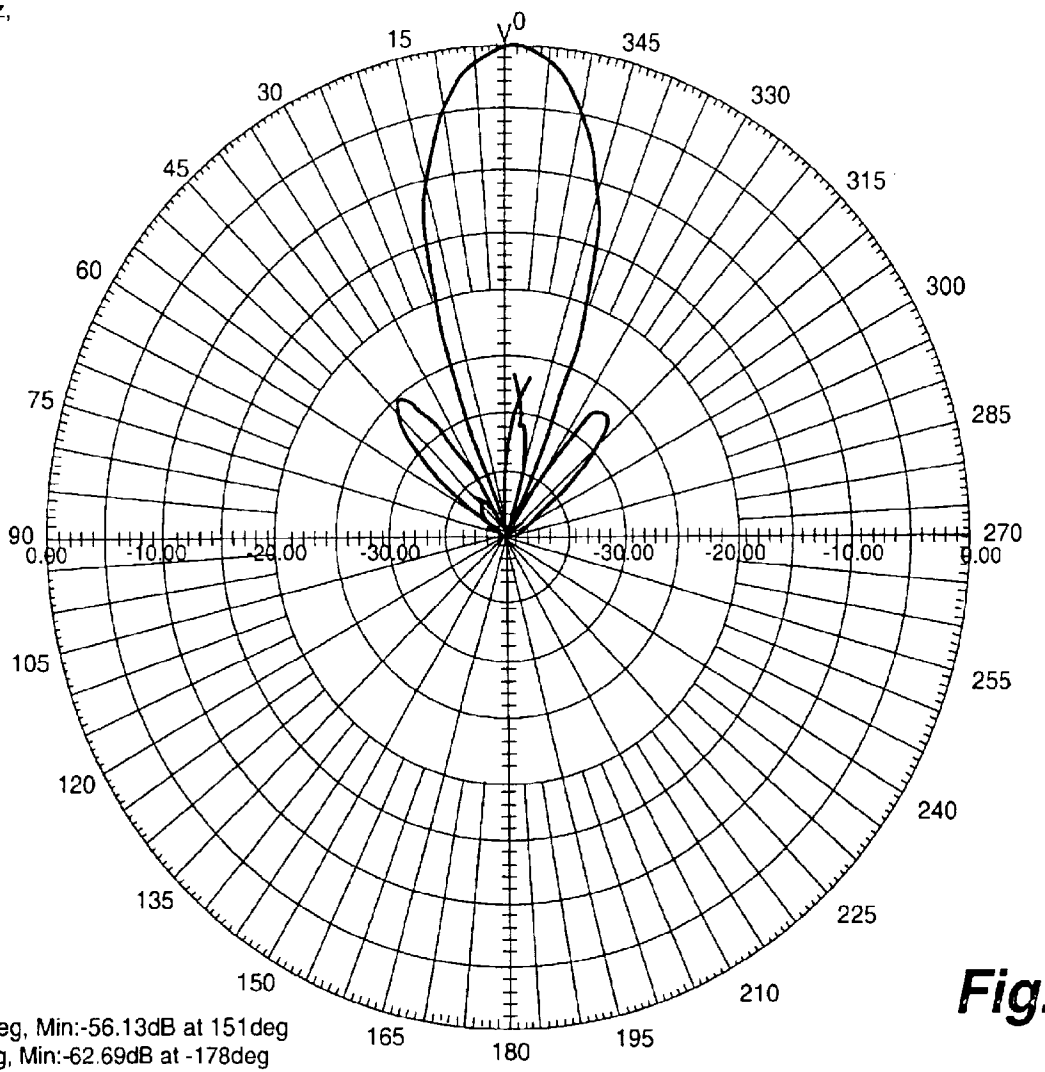
Figure 10C:
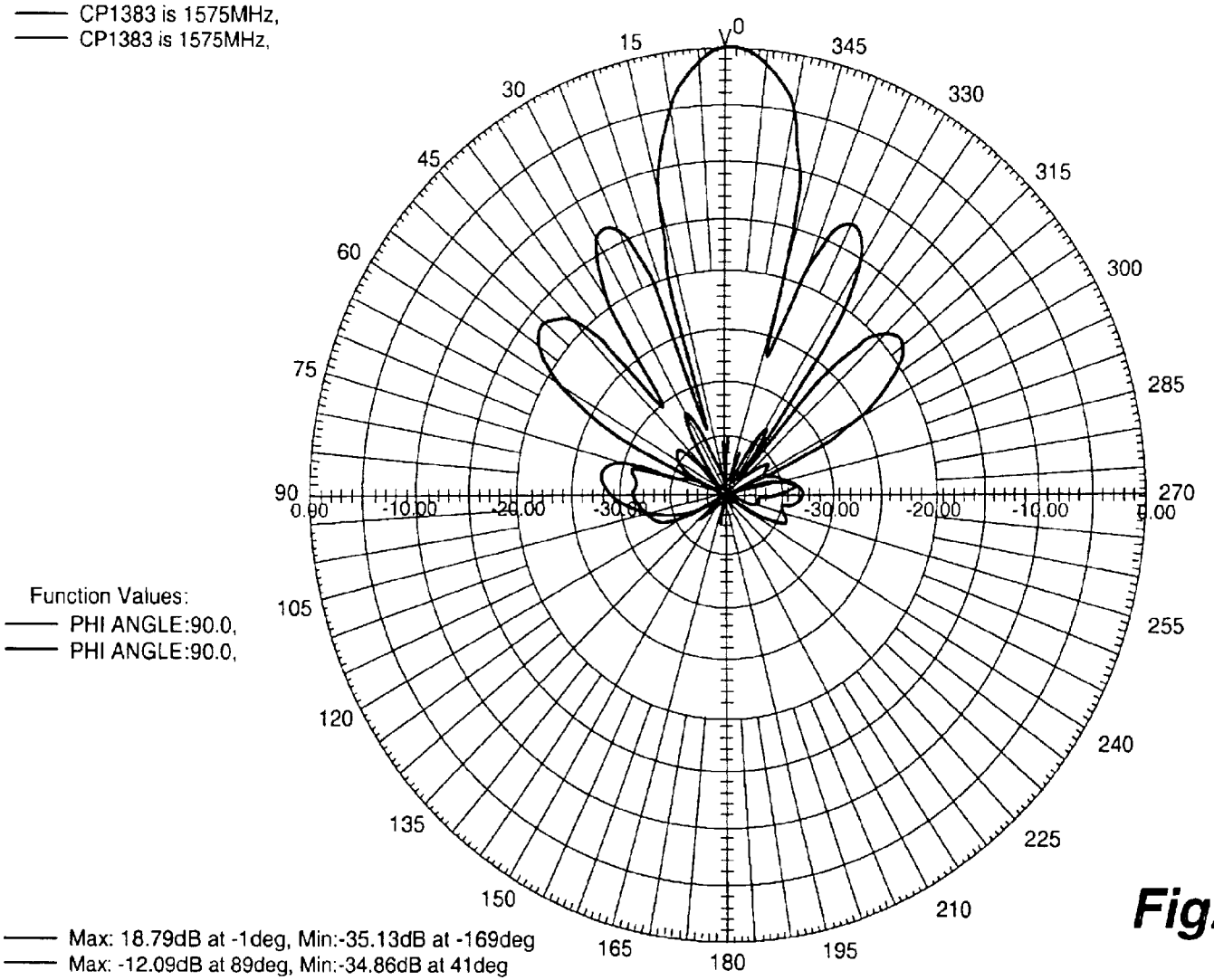
Figure 10D:
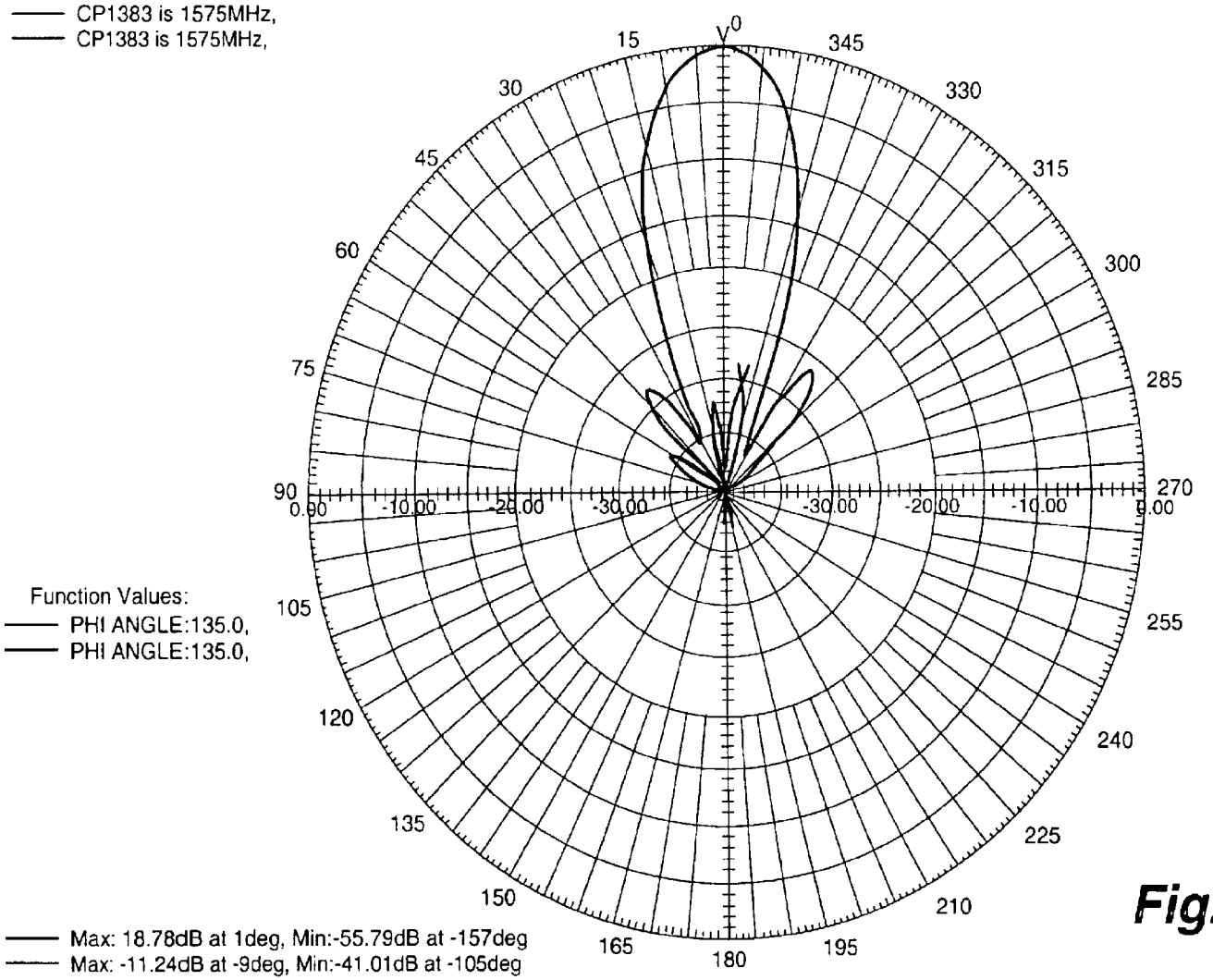
Figure 11A:
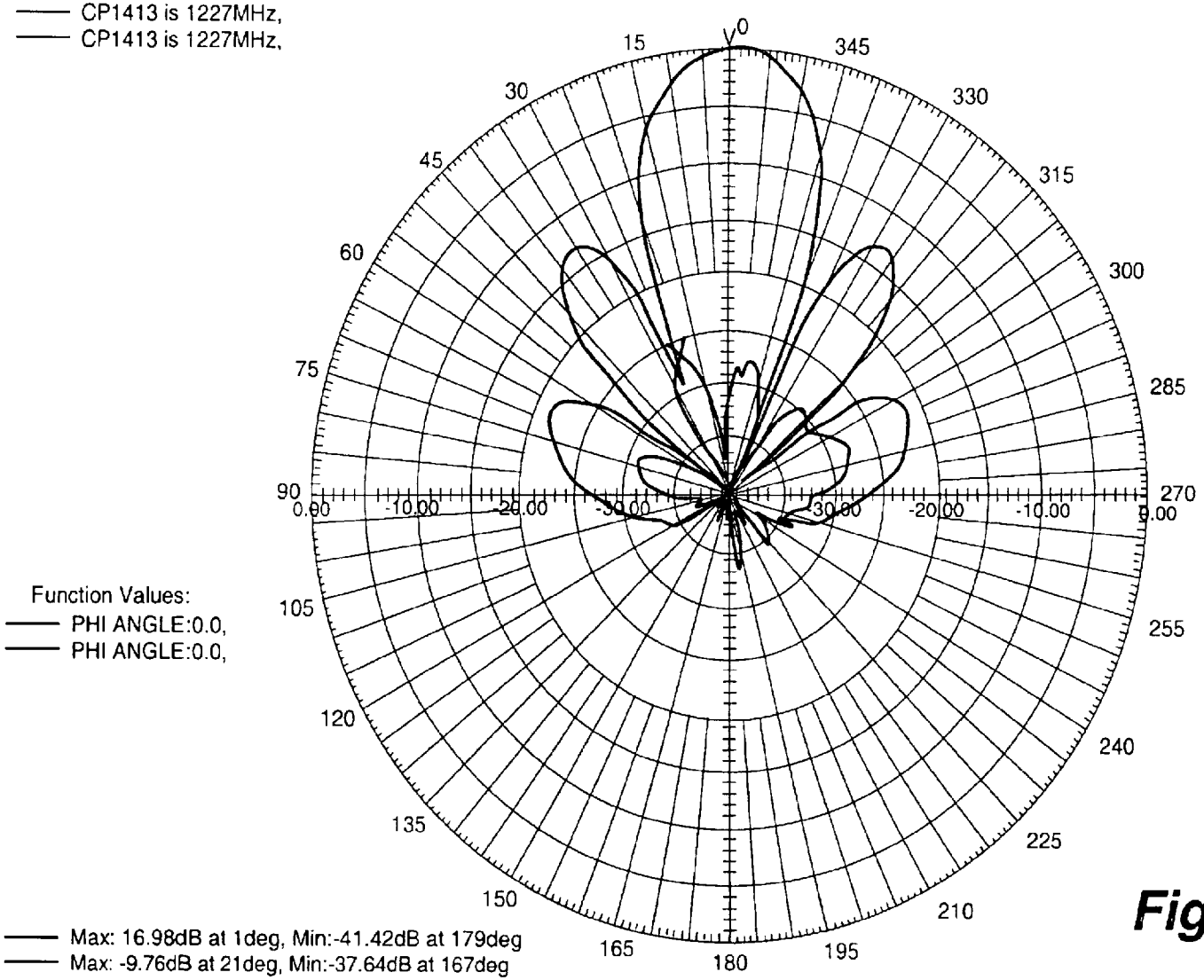
FIGS. 11A–11D illustrate radiation patterns produced by a second array of a dual band array antenna operating at a second frequency in accordance with an embodiment of the present invention.
Figure 11B:
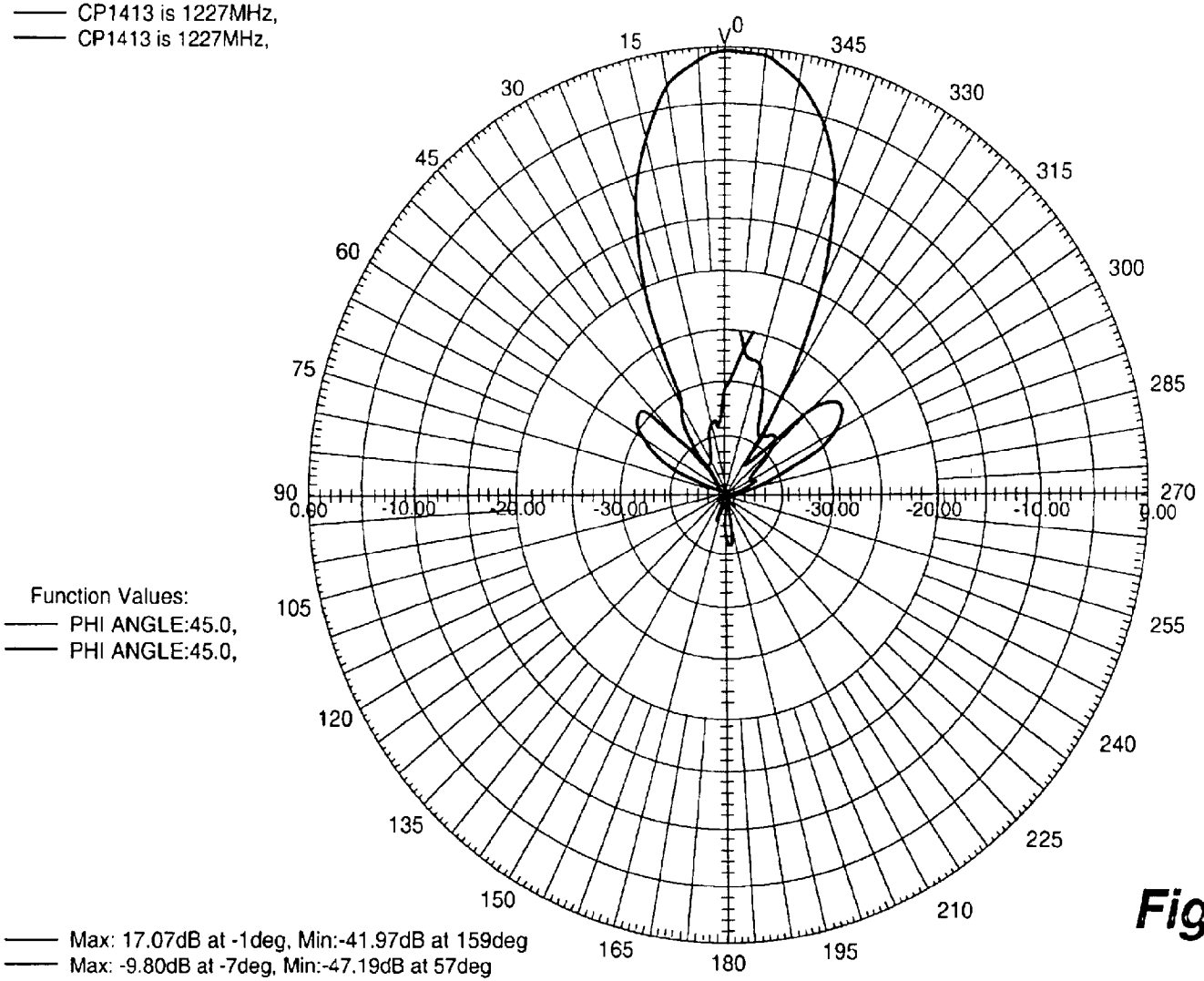
Figure 11C:
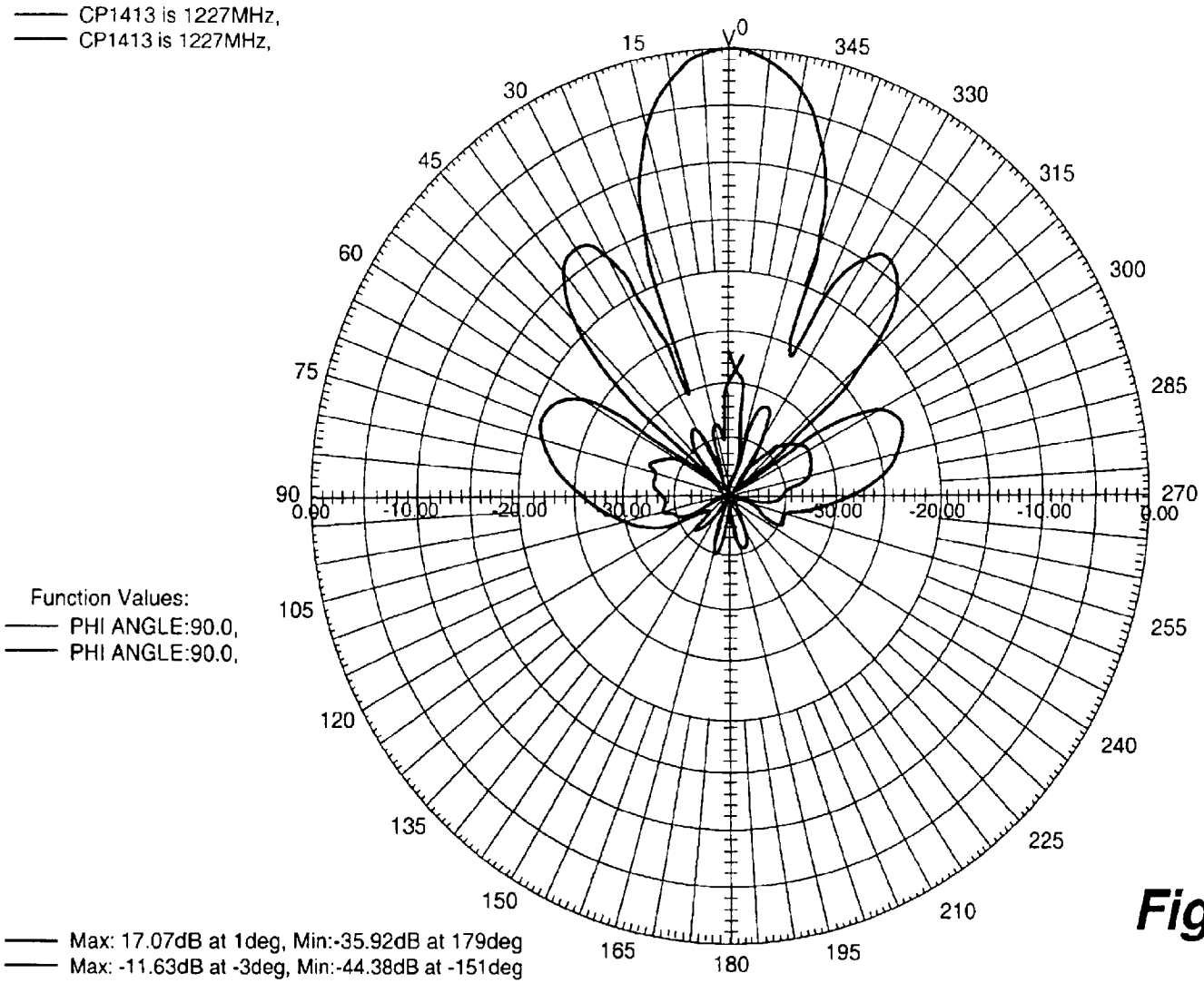
Figure 11D:
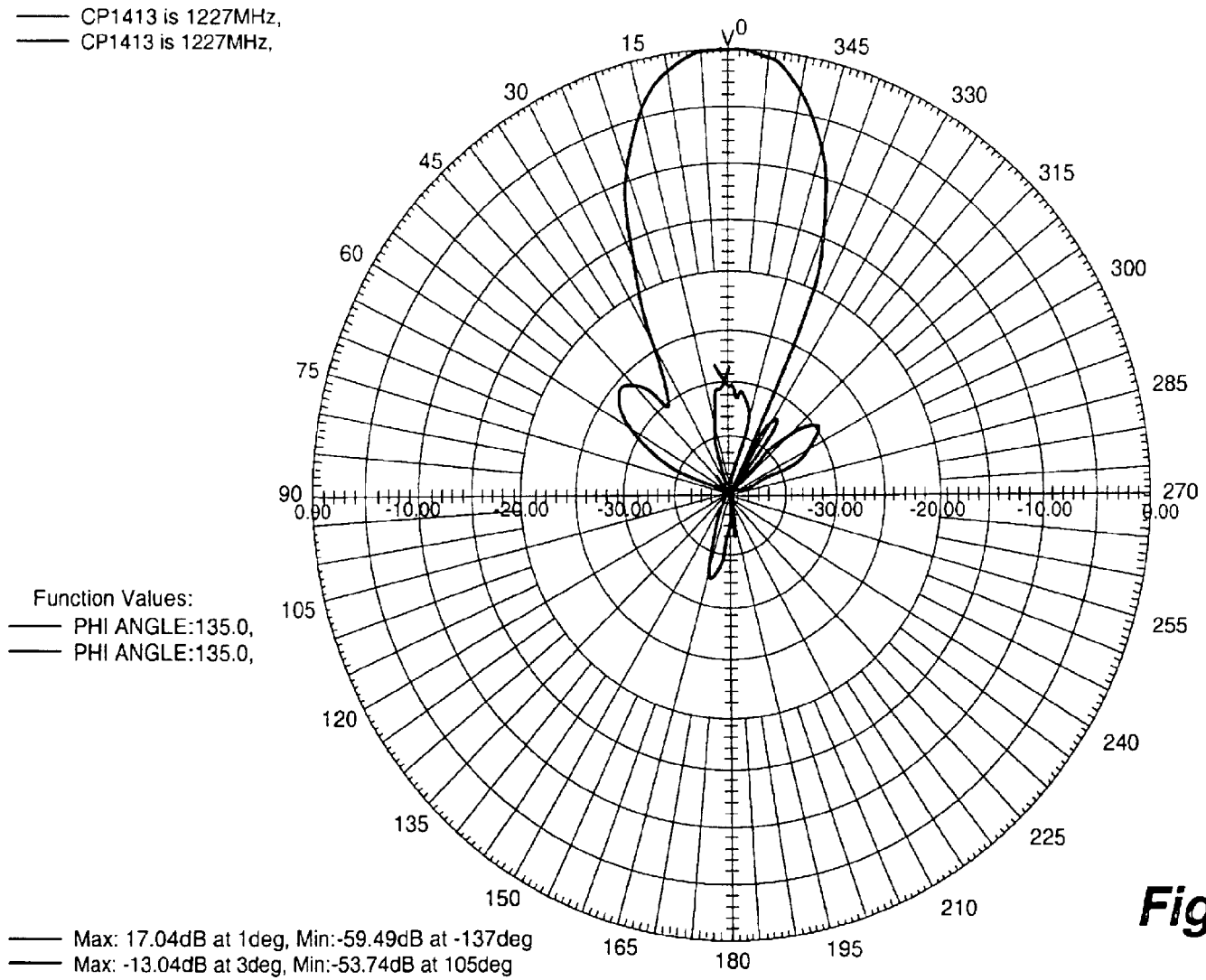

With reference now to FIG. 9, a flow chart illustrating the manufacture of a dual band array antenna in accordance with an embodiment of the present invention is illustrated. Initially, at step 900, the dual band co-planar antenna is dimensioned as described above in connection with FIG. 8. Next, a first plurality of antenna elements is formed on a first dielectric (step 904). A second plurality of antenna elements is then formed on a second dielectric material 908. At step 912, the first plurality of antenna elements is positioned on a ground plane in a rectangular lattice pattern, with a lattice spacing equal to $L_{max}$ to form a first array. At step 916, the second plurality of antenna elements is positioned on the ground plane in a rectangular lattice pattern with a lattice spacing equal to $L_{max}$ to form a second array interlaced with the first array.

As an example of the dimensioning of a phased array antenna in accordance with an embodiment of the invention, the selected first center or operating frequency ($f_1$) may be equal to 1,575 megahertz, and the second operating or center frequency ($f_2$) may be equal to 1,227 megahertz. The selected scan ranges for both frequencies may be 14 degrees. Initially, $L_{MAX}$ is calculated from $L_n<\lambda_n/(1+\sin(\theta_n))$ to equal 15.337 cm. Next, a first dielectric constant value ($er_1$) that satisfies the inequality $er_1>0.8453\ (\lambda_1/L_{max})^2$ and that is no less than 1.0 is chosen. According to the present example, a value of $er_1=1.3038$ is selected. Next, a second dielectric constant value ($er_2$) is calculated as follows: $er_2=er_1(f_1/f_2)^2=2.1482$. The effective diameter $D_{neff}$ is then calculated from $$D_{neff} = \left(\frac{0.65\lambda_n}{\sqrt{er_n}}\right)$$

to be 10.843 cm. Finally, using circular radiator elements, the radiator elements of the first array are calculated to have a diameter of 8.7 cm, and the radiator elements of the second array are calculated to have a diameter of 9.2 cm. According to this example, both arrays have an equal scan range in each dimension. Therefore, only one value for $L_{max}$ is calculated, and the elements of the arrays are arranged about a square lattice.

In FIGS. 10A–10D, the radiation pattern produced by a first array of antenna elements included as part of an example dual band array antenna in accordance with the present invention in various planes ($\phi$=0, 45, 90 and 135 degrees) through the antenna and for a first operating frequency are illustrated. In FIGS. 11A–11D, the radiation patterns produced by a second array of antenna elements included as part of the example dual band frequency antenna in various planes ($\phi$=0, 45, 90 and 135 degrees) through the antenna and for a second operating frequency are illustrated. The radiation patterns illustrated in FIGS. 10 and 11 are practically indistinguishable from the radiator patterns obtained from independent, non-interlaced arrays that provide similar operating characteristics. Therefore, it can be appreciated that the present invention provides dual band antenna characteristics using an antenna that occupies much less area than a conventional antenna utilizing two independent, non-interlaced arrays capable of providing comparable operating characteristics.

Figure 12:
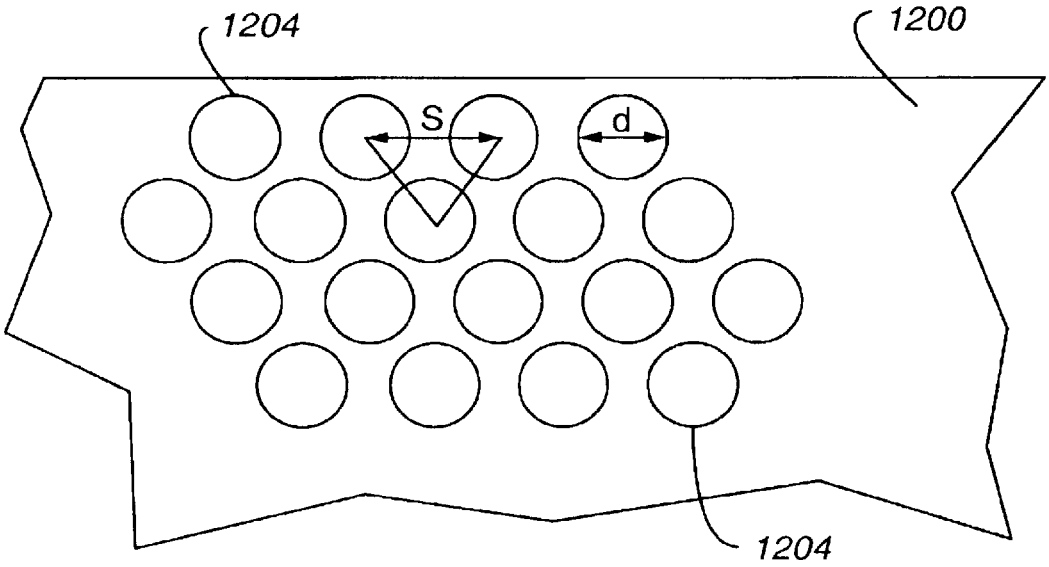
FIG. 12 is a schematic representation of a dielectric material having a modified dielectric constant in accordance with an embodiment of the present invention.

As can be appreciated by one of ordinary skill in the art, materials having certain dielectric constants may not be available, or may be difficult and expensive to obtain. In accordance with an embodiment of the present invention, the dielectric constant of a solid sheet of material 1200 may be lowered by drilling holes 1204 of appropriate diameter in a uniform, equilateral triangular pattern, as shown in FIG. 12. Using an equivalent static capacitance approach, the modified effective dielectric constant em is given by the equation $em=er-0.25(er-1)\pi d^2/0.866S^2$, where er is the dielectric constant of the solid material, S is the nearest neighbor spacing between the holes, and d is the diameter of the holes.

In general, when using this technique, S and d should be very small compared to the highest operating wavelength of the radiator elements used in connection with the dielectric material. For example, the inventors have found that acceptable results are obtained if S and d are both less than $\lambda/64$, where $\lambda$ is equal to the wavelength of the highest operating frequency of the antenna. In addition, S must be greater than d, since S–d represents the wall thickness between holes. Accordingly, in order to use this method, one starts with a hole diameter d that is less than $\lambda/64$, and then calculates the spacing S using the following equation, which can be readily derived from the equation given above for the modified dielectric constant:

$$S = 0.9523\,d\sqrt{\frac{(er-1)}{(er-em)}}\,.$$

If the resulting wall thickness S–d is too small or is negative, the dielectric constant of the solid material cannot be lowered to the desired level without violating the condition that d be less than $\lambda/64$ using this approach.

As an example, the dielectric constant value er of a typical substrate material is 2.33. According to the present example, it will be assumed that the desired modified effective dielectric constant $e_m$ is 1.5. The diameter of the holes will be selected to be d=0.0635 inch, which corresponds to a standard drill bit size, and which satisfies the inequality $d<\lambda/64$. Using the equation given above, we obtain a value of S=0.0764 inch. This corresponds to a wall thickness of 0.0129 inch.

If a lower modified effective dielectric constant were desired, for example, $e_m$=1.4, then a larger hole diameter, for example, 0.1 inch, could be used. According to this second example, S is equal to 0.1137, resulting in a wall thickness of 0.0137 inch. Using this configuration, S and d would continue to satisfy the requirement that they be less than $\lambda/64$ up to a frequency of 1,623 MHZ. Therefore, such a configuration could be used in connection with GPS frequencies, which are 1,227 MHZ and 1,575 MHZ. Furthermore, it should be noted that the requirement that S and d be less than $\lambda/64$ is a guideline, and can be exceeded in particular circumstances.

The disclosed technique for modifying the dielectric constant of a solid sheet of material is particularly suited for use in connection with dual frequency arrays with interleaved elements as described herein. The hole patterns in the dielectric substrates can be locally tailored to provide the desired dielectric constant required by the radiating elements operating at each frequency. Therefore, in accordance with the present invention, it can be appreciated that the first 120 and second 124 dielectric materials may be formed from a common dielectric material, with the effective dielectric constant of the material modified with respect to either or both of the first and/or second pluralities of radiator elements 104, 108. In addition, it should be appreciated that the dielectric materials 120, 124 can be formed from a single sheet or piece of dielectric material that is modified in areas adjacent to the first plurality of radiator elements 104 using a first diameter and spacing of holes, and is modified in areas adjacent the second plurality of radiator elements 108 using a second diameter and spacing between holes.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention, and to enable others skilled in the art to utilize the invention in such and in other embodiments and with various modifications required by their particular application or use of the invention. It is intended that the appended claims be construed to include alternative embodiments to the extent permitted by the prior art.

What is claimed is:

1. A dual band coplanar antenna, comprising:

a first plurality of radiator elements comprising a first array;

a second plurality of radiator elements comprising a second array, wherein said first plurality of radiator elements are interlaced with said second plurality of radiator elements, and wherein said first array is substantially coplanar with said second array;

a first dielectric substrate having a first dielectric constant, wherein said first dielectric substrate forms a substrate with respect to said first plurality of radiator elements; and a second dielectric substrate having a second dielectric constant, wherein said second dielectric substrate forms a substrate with respect to said second plurality of radiator elements.

2. The antenna of claim 1, further comprising a ground plane, wherein said first and second dielectric substrates are interconnected to said ground plane.

3. The antenna of claim 1, wherein said first and second dielectric substrates are formed from a common piece of material such that said first and second dielectric substrates are integral to one another, and wherein at least a portion of said common piece of material is modified to form at least one of said first dielectric material and said second dielectric material.

4. The antenna of claim 1, wherein said first and second dielectric substrates are formed from a common piece of material, and wherein holes are formed in at least a first area of said common piece of material to provide at least one of said first dielectric constant and said second dielectric constant.

5. The antenna of claim 1 wherein said first radiator elements are a first physical size, and wherein said second radiator elements are a second physical size.

6. The antenna of claim 1, wherein an effective size of said first radiator elements is equal to an effective size of said second radiator elements.

7. The antenna of claim 1, wherein said first and second arrays are arranged about first and second rectangular lattices.

8. The antenna of claim 7, wherein said first and second rectangular lattices have a first lattice spacing.

9. The antenna of claim 8, wherein said first lattice spacing is equal to a maximum lattice spacing.

10. The antenna of claim 1, wherein said first array has a first frequency of operation, wherein said second array has a second frequency of operation, and wherein said second dielectric has a dielectric constant ($er_2$) given by the expression $er_2=er_1*(f_1/f_2)^2$.

11. The antenna of claim 1, wherein said radiator elements comprise microstrip patches.

12. The antenna of claim 1, wherein said radiator elements comprise circular microstrip patches.

13. The antenna of claim 1, wherein said radiator elements comprise square microstrip patches.

14. The antenna of claim 1, wherein said radiator elements comprise dipole microstrip patches.

15. The antenna of claim 1, wherein an area occupied by said first array substantially overlaps an area occupied by said second array.

16. The antenna of claim 1, further comprising a plurality of signal amplifiers, wherein at least one amplifier is associated with each radiator element of said first and second arrays.

17. The antenna of claim 1, wherein each of said radiator elements of at least one of said first and second arrays comprises a plurality of feed points.

18. The antenna of claim 1, further comprising a plurality of signal amplifiers, wherein each of said radiator elements of at least one of said first and second arrays comprises a plurality of feed points, and wherein at least a first signal amplifier is provided for each of said feed points.

19. A method for providing a dual frequency band antenna apparatus, comprising:

selecting a first center frequency;

selecting a second center frequency;

selecting a desired scan range for said first center frequency;

selecting a desired scan range for said second center frequency;

calculating a first lattice spacing between a first plurality of radiator elements associated with said first center frequency, wherein said first lattice spacing comprises a function of a wavelength of said first center frequency and said selected scan range of said first center frequency;

calculating a second lattice spacing between a second plurality of radiator elements associated with said second center frequency, wherein said second lattice spacing comprises a function of a wavelength of said second center frequency and said selected scan range of said second center frequency;

determining a maximum lattice spacing, wherein said maximum lattice spacing is the smaller of said first and second lattice spacings, wherein a first array is arranged about a square lattice, wherein said radiator elements of said first lattice have a center to center spacing equal to said maximum lattice spacing, wherein a second array is arranged about a square lattice, and wherein said radiator elements of said second lattice have a center to center spacing equal to said maximum lattice spacing;

selecting a minimum first substrate dielectric constant, wherein said selected first substrate dielectric constant is greater than a function of said wavelength of said first center frequency and said maximum lattice spacing, and wherein said first substrate dielectric constant is no less than 1.0;

calculating a second substrate dielectric constant, wherein said second substrate dielectric constant comprises a function of said selected minimum first substrate dielectric constant, said first center frequency, and said second center frequency;

calculating an effective size of said radiator elements included in said first plurality of radiator elements and said radiator elements included in said second plurality of radiator elements, wherein said effective size comprises a function of a wavelength of a one of said first and second frequencies and a corresponding one of said first and second substrate dielectric constants;

calculating a physical size of said radiator elements included in said first plurality of radiator elements; and calculating a physical size of said radiator elements included in said second plurality of radiator elements.

20. The method of claim 19, further comprising:

forming said first plurality of radiator elements on dielectric material having a dielectric constant equal to said minimum first substrate dielectric constant;

forming said second plurality of radiator elements on dielectric material having a dielectric constant equal to said second dielectric constant;

forming a first array from said first plurality of radiator elements, wherein said first plurality of radiator elements are arranged in a square lattice, and wherein said first plurality of radiator elements have a center to center spacing equal to said maximum lattice spacing; and forming a second array from said second plurality of radiator elements, wherein said second plurality of radiator elements are arranged in a square lattice, wherein said second plurality of radiator elements have a center to center lattice spacing equal to said maximum lattice spacing, and wherein said first array is interlaced with said second array.

21. The method of claim 20, wherein an area of said first array substantially overlaps with an area of said second array.

22. The method of claim 20, wherein said first array and said second arrays are substantially coplanar.

23. The method of claim 20, wherein forming said first and second arrays comprises:

mounting said first radiator elements and said first dielectric material to a ground plane; and mounting said second radiator elements and said second dielectric material to said ground plane.

24. The method of claim 20, wherein said radiator elements comprise microstrip patches.

25. The method of claim 20, wherein radiator elements along two contiguous sides of said antenna consist of radiator elements from said first plurality of radiator elements.

26. The method of claim 19, further comprising:

calculating an exclusion radius extending about a center point of said radiator elements; and in response to determining that a radiator element of said first array encroaches an exclusion zone about a radiator element of said second array, selecting a first substrate dielectric having a greater dielectric constant value and recalculating said second substrate dielectric constant.

27. The method of claim 26, wherein said exclusion zone is greater than said effective diameter of said radiator elements associated with said first center frequency.

28. The method of claim 27, wherein said exclusion zone extends three times the thickness of the substrate beyond the edge of the radiating element.

29. The method of claim 19, wherein said dual frequency band antenna apparatus is provided for use in an application in which a total surface area of said antenna is restricted.

30. The method of claim 20, further comprising:

selecting a dielectric substrate;

modifying said dielectric substrate to have said first selected substrate dielectric constant in at least a first area on which said first plurality of radiator elements are formed.

31. The method of claim 30, further comprising modifying said dielectric substrate to have said calculated second dielectric constant in at least a second area on which said second plurality of radiator elements are formed.

32. The method of claim 20, wherein said step of forming said first plurality of radiator elements is integral to said step of forming a first array from said first plurality of radiator elements.

33. The method of claim 20, wherein said step of forming said second plurality of radiator elements is integral to said step of forming a second array from said second plurality of radiator elements.

34. A method for dimensioning a dual band array antenna apparatus, comprising:

determining a desired scan range ($\theta_1$) for a first operating frequency ($f_1$) of said apparatus;

determining a desired scan range ($\theta_2$) for a second operating frequency ($f_2$) of said apparatus;

calculating a maximum element spacing ($L_{max}$), wherein said maximum element spacing is no greater than $\lambda_1/(1+\sin(\theta_1))$ and is no greater than $\lambda_2/(1+\sin(\theta_2))$, wherein $\lambda_1$ is a wavelength of said first operating frequency, and wherein $\lambda_2$ is a wavelength of said second operating frequency;

calculating a first dielectric constant ($er_1$) of a first plurality of patch radiators, wherein said first dielectric constant is greater than $0.8453*(\lambda_1/L_{max})^2$;

calculating a second dielectric constant ($er_2$) of a second plurality of patch radiators, wherein said second dielectric constant is equal to $er_1*(f_1/f_2)^2$;

calculating an effective diameter of said radiators, wherein said effective diameter is equal to $0.65*\lambda_1/\mathrm{sqrt}(er_1)$;

calculating a physical patch diameter for said first plurality of patch radiators for use in connection with said first frequency; and calculating a physical patch diameter for said second plurality of patch radiators for use in connection with said second frequency.

35. The method of claim 34, wherein said first plurality of patch radiators form a first array, wherein said patch radiators of said first array have a center to center spacing equal to $L_{max}$, and wherein a total area of said first array is equal to $A_1$.

36. The method of claim 35, wherein said second plurality of patch radiators form a second array, wherein said patch radiators of said second array have a center to center spacing equal to $L_{max}$, and wherein a total area of said second array is equal to $A_2$.

37. The method of claim 36, wherein said first array is interlaced with said second array to provide said dual band antenna apparatus, and wherein an area of said dual band antenna apparatus is about equal to $A_1$.

38. The method of claim 34, further comprising:

selecting a dielectric material having a selected dielectric constant (er); and modifying said dielectric material in at least a first area to obtain a modified dielectric constant (em).

39. The method of claim 38, wherein said step of modifying comprises forming holes in said at least a first area, and wherein, $em=er-0.25(er-1)\pi d^2/0.866S^2$, where d is the diameter of the holes and where S is the hole spacing.

40. The method of claim 39, wherein $S<\lambda/64$ and $d<\lambda/64$, and where $S>d$.

* * * * *